US005752816A

United States Patent [19]

Shaffer

[11] Patent Number: 5,752,816

[45] Date of Patent: May 19, 1998

[54] SCROLL FLUID DISPLACEMENT APPARATUS WITH IMPROVED SEALING MEANS

[75] Inventor: Robert W. Shaffer, Hamilton, Ohio

[73] Assignee: Air Squared,Inc., Hamilton, Ohio

[21] Appl. No.: 728,781

[22] Filed: Oct. 10, 1996

[51] Int. Cl.[6] ..... F01C 1/04; F01C 19/00

[52] U.S. Cl. ..... 418/55.2; 418/55.3; 418/55.5; 418/57

[58] Field of Search ..... 418/55.2, 55.3, 418/55.5, 57

[56] References Cited

U.S. PATENT DOCUMENTS

| | | | |
|---|---|---|---|
| 3,817,664 | 6/1974 | Bennett et al. | 418/55.5 |
| 3,884,599 | 5/1975 | Young et al. | 418/55.5 |
| 3,924,977 | 12/1975 | McCullough | 418/55.5 |
| 3,994,633 | 11/1976 | Shaffer | 418/5 |
| 4,157,234 | 6/1979 | Weaver et al. | 418/6 |
| 4,192,152 | 3/1980 | Armstrong et al. | 62/402 |
| 4,300,875 | 11/1981 | Fischer et al. | 418/57 |
| 4,443,166 | 4/1984 | Ikegawa et al. | 418/55.2 |
| 4,764,096 | 8/1988 | Sawai et al. | 418/55.5 |
| 4,892,469 | 1/1990 | McCullough et al. | 418/55.5 |
| 5,035,589 | 7/1991 | Fraser, Jr. et al. | 418/55.2 |
| 5,154,592 | 10/1992 | Ohtani et al. | 418/55.3 |
| 5,224,849 | 7/1993 | Forni | 418/55.5 |
| 5,388,973 | 2/1995 | Richardson, Jr. | 418/55.2 |
| 5,466,134 | 11/1995 | Shaffer et al. | 418/15 |
| 5,511,959 | 4/1996 | Tojo et al. | 418/55.1 |

FOREIGN PATENT DOCUMENTS

| | | | |
|---|---|---|---|
| 3821125 | 2/1989 | Germany | 418/55.3 |
| 2-86976 | 3/1980 | Japan | 418/57 |
| 2123291 | 5/1990 | Japan | 418/57 |
| 3-57893 | 3/1991 | Japan | 418/55.5 |

OTHER PUBLICATIONS

Internet Webpage;http://idaho-web.com/lennox/scrollcm-.htm; Lennox Scroll Compressor Technology; Sep. 2, 1996.

*Primary Examiner*—John J. Vrablik
*Attorney, Agent, or Firm*—Biebel & French

[57] ABSTRACT

A scroll fluid displacement apparatus with improved tangential and radial sealing means is disclosed. The apparatus comprises scroll members including meshing involutes which are angularly offset such that they define one or more moving fluid pockets of variable volume as well as a theoretical eccentric separating the involute axes. Tangential and radial sealing is preferably provided by a drive shaft which provides both radial and axial load forces between the involutes. The drive shaft separates the involute centers by a distance not equal to the theoretical eccentric thereby causing the involutes to maintain a radial contacting relationship with each other for effective tangential sealing. Radial sealing is attained by withdrawing a portion of fluid from the fluid pocket of highest pressure for pressurizing a chamber within the drive shaft. The pressure acts against a piston engaging a scroll member which is adapted for axial movement, thereby generating radial sealing forces. The involutes have tips with recessed portions therein for accelerated initial surface wear and improved radial sealing. Idler crank assemblies having axial compliance are provided to maintain the desired angular relationship between the scroll members. In one alternative embodiment, the idler crank assemblies provide for tangential sealing by separating the involute centers by a distance not equal to the theoretical eccentric.

30 Claims, 15 Drawing Sheets

SCROLL FLUID DISPLACEMENT APPARATUS WITH IMPROVED SEALING MEANS

BACKGROUND OF THE INVENTION

1. Field of the Invention

The present invention relates to a scroll type fluid displacement apparatus, and more particularly, to a scroll apparatus capable of maintaining high efficiency through improved sealing means.

2. Description of the Prior Art

In a typical fluid displacement apparatus, a working fluid is drawn into an inlet port and discharged through an outlet port at a different pressure. If the fluid has a reduced volume and a higher pressure when discharged, then the apparatus serves as a compressor or vacuum pump. If the working fluid volume increases while the pressure decreases, then the apparatus is an expansion engine capable of delivering mechanical energy. Finally, a fluid may be introduced and withdrawn at different pressures but with essentially constant volume, in which case the apparatus serves as a fluid pump.

In the following description, a compressor will be used to illustrate the present invention. However, it is to be understood that the principles of this invention will apply equally to other types of fluid displacement apparatuses including expansion engines, vacuum pumps and fluid pumps.

There is well known in the art a class of fluid displacement devices generally referred to as "scroll" pumps, compressors and engines. Scroll compressors are often used in equipment such as oxygen concentrators, refrigerators, air conditioners and heat pumps. Scroll compressors are often preferred for such applications because they tend to be quieter in operation, simpler in design, and more efficient than traditional piston compressors. U.S. Pat. No. 4,157,234 to Weaver et al. describes this general type of device and is incorporated herein by reference.

Scroll compressors operate on the principle of two intermeshing involutes or spiral wraps which extend from opposing plates and make moving contact to isolate volumes, called "fluid pockets." These pockets are defined by line contacts between spiral cylindrical surfaces and area contacts between plane surfaces. One involute is fixed and the other is driven in orbiting motion, typically by an electric motor. The orbiting motion of the orbiting involute causes the fluid pockets to move from one or more fluid inlets at the outer edges of the involutes toward the center of the involutes where an outlet is provided and the fluid is released. As the fluid pockets move toward the center of the involutes, they become smaller thereby compressing the fluid contained therein.

The involutes are usually contained within opposing end plates such that the tip surface of each involute contacts the surface of the opposing end plate. The orbiting involute and end plate define an orbiting scroll member, while the stationary involute and end plate define a stationary scroll member. While the involutes have the same pitch, they are angularly and radially offset to contact one another along at least one pair of line contacts. The pair of line contacts will lie approximately upon one radius drawn outwardly from the central region of the involutes. The sealed fluid pocket is bounded by two parallel planes defined by the opposing end plates and by two cylindrical surfaces defined by the involutes and line contacts. The fluid volume so formed typically extends all the way around the central region of the involutes. In certain unusual cases, the fluid pocket will not extend a full 360° because of special porting arrangements. The volume of each fluid pocket varies with relative orbiting of the involute centers while all of the pockets maintain the same relative angular position. As the line contacts move along the involute surfaces, the pockets thus formed experience a change in volume and pressure. The resulting pockets of highest and lowest pressures are connected to fluid ports.

Although scroll type fluid displacement apparatuses have gained wide acceptance and are recognized as possessing many distinct advantages, traditionally such devices have demonstrated sealing problems which have placed severe limitations on the efficiencies, operating life, and pressure ratios attainable.

It is well known that a principal factor in achieving acceptable operating efficiencies and compressor performance is to minimize fluid leakage. Leakage from the fluid pockets may occur either tangentially or radially. Tangential leakage occurs along the moving line contacts made between the involutes from a higher pressure fluid pocket to a lower pressure fluid pocket. Radial leakage involves fluid passing from a higher pressure pocket to a lower pressure pocket between the tip surfaces of the involutes and the opposing end plate surfaces.

One prior art approach to effect improved sealing has been to manufacture the finished shape and dimension of each involute with extreme accuracy. For this purpose, the involute is usually machined from a metallic material to precise shapes for fitting with very small tolerances in order to minimize sealing gaps and maintain useful pressure ratios. Such high precision machining is a difficult, time consuming and expensive process.

It has been proposed to use near net shape scrolls, including those made of injection molded plastic or powdered metal, as inexpensive substitutes for the more expensive precision machined metal scrolls. However, near net shape scrolls cannot be manufactured to the same level of accuracy as the prior art machined metal scrolls. Alternative means for ensuring adequate tangential and radial sealing must therefore be provided.

Prior art scroll compressors typically employ separate mechanisms to attain tangential and radial sealing. Tangential sealing may be accomplished by controlling radial contacting forces through the use of a radially compliant mechanical linking means between the orbiting scroll and its drive means. This linking means controls the tangential sealing forces along line contacts between the involutes of the scroll members. U.S. Pat. No. 3,924,977 to McCullough discloses such a linking means which is capable of providing a centripetal force to counter balance a fraction of the centrifugal force acting on the orbiting scroll member as it orbits. A portion of the centrifugal force remains for effecting controlled tangential sealing. The compliant mechanical linking means utilizes mechanical springs to provide the centripetal force. Alternatively, counterweights may be used to counterbalance substantially all of the centrifugal forces acting upon the orbiting scroll member while a swing-link incorporating mechanical springs provides the desired tangential sealing force. A modified version of such a swing-link mechanism is disclosed in U.S. Pat. No. 4,892,469 to McCullough et al. These prior art approaches for attaining improved tangential sealing have resulted in complex, and therefore relatively expensive, mechanisms. Furthermore, such devices typically do not address the need for improved radial sealing.

In prior art scroll compressors, radial sealing has often been attempted through the use of one or more mechanical axial constraints. One example of such an approach is disclosed in U.S. Pat. 5,466,134 to Shaffer et al. wherein the axial clearance between the orbiting and stationary scroll members may be adjusted through nuts engaging threaded shafts which operably connect the scroll members. Some prior art mechanical axial constraints require precise adjustment to attain efficient radial sealing without undue wearing and must be continually monitored and adjusted during operation of the compressor to account for wearing of the scroll members. Compliant seals within the tip surfaces of the involutes have been utilized to eliminate the need for continued adjustment of prior art mechanical axial constraints. The compliant seals attempt to seal any clearance between the involutes and the opposing end plate surfaces. An example of such an approach is disclosed in U.S. Pat. No. 5,466,134 to Shaffer et al. as referenced above.

Another prior art approach to radial sealing has been the use of a combination of fluid and spring forces acting upon the orbiting scroll member. The orbiting scroll member is allowed to axially "float" relative to the stationary scroll member in response to the fluid and spring forces. The fluid may be derived from the moving fluid pockets defined within the apparatus or from an independent source to generate axial forces thereby promoting radial sealing between the scroll members.

While the above identified prior art methods of attaining tangential and radial sealing have achieved limited success, there remains a need for a mechanism that provides effective tangential sealing between the involutes of a scroll fluid displacement apparatus. Furthermore, a single mechanism of simple design is needed to provide such tangential sealing while simultaneously providing effective radial sealing. In addition, there is a need for such a mechanism that provides axial and radial compliance to compensate for the wearing of the scroll members. In particular, there is a need for a mechanism providing both axial and radial compliance to provide enhanced radial and tangential sealing between opposing near net shape scroll members.

SUMMARY OF THE INVENTION

The present invention provides a scroll fluid displacement apparatus having improved radial and tangential sealing means.

The scroll fluid displacement apparatus comprises a housing including a circumferential side wall and a first end wall in which a motor shaft is rotatably mounted. The motor shaft has a longitudinal axis and extends into the housing. A stationary scroll member is fixed to the housing and an orbiting scroll member is adapted for orbiting movement within the housing relative to the stationary scroll member.

The stationary and orbiting scroll members include stationary and orbiting plates respectively. The scroll members are preferably made from a near net shape process including, but not limited to, the injection molding of plastic. Each plate includes inboard and outboard surfaces wherein an involute extends from each inboard surface. The stationary scroll plate also defines at least one inlet and an outlet. The two involutes have the same pitch and thickness but are 180° out of phase wherein the center axes of the involutes are aligned so that at least one pair of line contacts are defined between the involutes along a radius drawn approximately through the orbiting involute center axis. The meshing involutes define suction zones at the outer ends of the involutes and fluid pockets of variable volume and pressure. The fluid pockets are reduced in size as the orbiting involute orbits relative to the stationary involute. Fluid is moved from the inlets at the outside of the involutes to the outlet proximate the end or center of the involutes.

A theoretical eccentric between the center axes of the involutes is defined by the properties of the meshing involutes. The value of the theoretical eccentric is calculated based upon the pitch and thickness of the involutes by the equation $t=(p/2)-I$ wherein t equals the theoretical eccentric, p equals the involute pitch, and I equals the involute thickness. The stationary involute center axis is preferably aligned coaxial to the motor shaft axis.

A drive shaft including a support member having first and second ends is eccentrically mounted to the motor shaft for orbitally rotating the orbiting scroll member in response to the rotation of the motor shaft. The first end is fixed to the motor shaft while the second end is positioned about the center axis of the orbiting involute.

In the preferred embodiment, the second end of the support member includes a cavity defining an inner surface. A piston is located within the cavity and is rotatably mounted to the orbiting plate in a manner providing for the axial movement of orbiting scroll member relative to the stationary scroll member. A compressible resilient member is supported in a circumferential channel on the outer surface of the piston for engaging the inner surface of the cavity and provides for radial compliance of the orbiting scroll member.

The drive shaft separates the orbiting involute center axis and the stationary involute center axis by an actual eccentric which is not equal to the theoretical eccentric as defined by the meshing involutes. An actual eccentric greater than the theoretical eccentric causes the inner surface of the support member to exert a radially outwardly acting force against the compressible resilient member and piston which is then transferred to the involutes. The radially outwardly acting force facilitates a radial contacting relationship between the orbiting and stationary involutes and therefore improved tangential sealing.

An actual eccentric which is less than the theoretical eccentric causes the inner surface of the support member to exert a radially inwardly acting force against the compressible resilient member and piston which is then transferred to the orbiting involute. This inwardly acting force opposes a portion of the centrifugal force which develops as the orbiting scroll orbits. Since the centrifugal force is reduced, less friction and wear occurs between the involutes while the remaining centrifugal force ensures effective tangential sealing. A decreased actual eccentric is used where the scroll members are relatively heavy and the orbiting scroll member generates a large centrifugal force as it orbits.

The piston and compressible resilient member slidably engage the inner surface of the cavity within the second end of the support member. A pressurizable fluid chamber is defined within the drive shaft by the inner surface of the cavity, the piston and the compressible resilient member. The fluid chamber is in communication with at least one fluid pocket formed between the two involutes. Additionally, a spring may be located within the fluid chamber and is supported on the piston. Pressure within the fluid chamber, in cooperation with the spring, provide an axial load supplying means for providing sealing engagement between the orbiting and stationary scroll members and thereby preventing radial leakage.

The spring provides an axial force proportional to the position of the piston. Upon start-up of the compressor when there is low pressure within the fluid pockets, the spring exerts most or all of the axial force against the piston. However, as the compressor operates and fluid pressure builds within the pockets between the scroll members, this pressure will be communicated to the pressurizable fluid chamber resulting in an additional axial force being exerted against the piston. This combined axial force causes the orbiting scroll member to maintain an axial contacting relationship with the stationary scroll member. More specifically, the axial force ensures effective sealing contact between the tips of the involutes and the inboard surface of the orbiting plate or stationary plate of the opposing scroll member.

As discussed earlier, in order for the compressor to operate properly, the two involutes must be 180° out of phase from each other. Preferably, two idler crank assemblies extend between the stationary and orbiting scrolls to maintain the phase relationship between the scroll members. The idler crank assemblies are preferably located near the periphery of the scroll members. Each idler crank assembly is adapted for axial compliance and includes first and second idler cranks operably connected. The first idler crank is rotatably mounted in the orbiting scroll member and the second idler crank is rotatably mounted in the stationary scroll member such that one idler crank orbits relative to the other when the orbiting scroll orbits.

Each idler crank includes a crank shaft having first and second ends wherein the first end is on the inboard side and the second end is on the outboard side of the respective scroll member. Each crank shaft has a head proximate its first end and the second crank shaft has a threaded end proximate its second end. The crank shafts are each journaled in at least one radial load bearing. A bearing nut engages the threaded end of the second crank shaft to restrain axial movement of the shaft. However, the axial movement of the first crank shaft is not restricted by a bearing nut and the shaft is free to float relative to the orbiting scroll member. This axial compliance of the first idler crank permits axial movement of the orbiting scroll member relative to the stationary scroll member for improved radial sealing.

A plate or disk is preferably positioned between the first and second idler cranks. The first ends of both crank shafts are fixed to the disk near its periphery wherein the crank shafts are diametrically opposed by a distance equal to the actual eccentric. This positioning of the shafts enables the first crank to orbit around the second crank as the orbiting scroll orbits.

Preferably, the bearings of each idler crank assembly are preloaded by a spring. In the first idler crank, the spring is positioned between a stop member proximate the second end of the shaft and the radial load bearing. The spring is located between the crank shaft head and one of the radial load bearings in the second idler crank.

The tips of both involutes are provided with recessed portions for promoting slight tip wear upon initial compressor operation. The recessed portions extend throughout the length of the involutes and have a limited depth. As the surface area surrounding the recessed portions wears, improved radial sealing is observed between the involute tips and the opposing scroll plate. A stabilizing surface is preferably provided on the stationary scroll and extends from the inboard surface of the stationary plate. The stabilizing surface has a height less than that of the involutes wherein the stabilizing surface prevents the continued accelerated wear of the involute tips once the involute height equals the stabilizing surface height.

In an alternative embodiment of the invention, the idler crank assembly, rather than the drive shaft, separates the orbiting and stationary center axes and thereby defines the actual eccentric. The first and second idler cranks in this embodiment include crank shafts journaled in radial load bearings. The bearings are received within the orbiting and stationary scroll members respectively. A resilient compressible member is positioned between the bearing and one of the first and second crank shafts thereby providing for radial compliance. The first and second idler cranks separate the orbiting involute center axis and the stationary involute center axis thereby defining an actual eccentric which is not equal to the theoretical eccentric as defined by the meshing involutes.

An actual eccentric greater than the theoretical eccentric causes the crank shaft to exert a radially outwardly acting force against the compressible resilient member which is transferred to the involutes. The radially outwardly acting force facilitates improved tangential sealing by maintaining a radial contacting relationship between the involutes. An actual eccentric less than the theoretical eccentric causes the crank shaft to exert a radially inwardly acting force against the compressible resilient member and orbiting involute. The inwardly acting force reduces the centrifugal force acting on the orbiting scroll member as it orbits thereby reducing the friction between the involutes.

In this alternative embodiment the drive shaft need not include the piston and resilient compressible member as described above. The drive shaft may comprise a single member which connects the motor shaft eccentrically to the orbiting scroll member such that an orbiting motion is imparted to the orbiting scroll member as the motor shaft rotates.

Therefore, it is an object of the present invention to provide a scroll fluid displacement apparatus which achieves efficient sealing between opposing scroll members.

It is another object of the invention to provide such a scroll apparatus in which improved sealing is obtained without requiring extreme precision in the manufacture of the scroll members.

An additional object of the invention is to provide such a scroll apparatus comprising inexpensive near net shape scroll members having involute tips with a structure for enhancing radial sealing.

It is a further object of the invention to provide such a scroll apparatus having a single mechanism of simple design which provides effective sealing between opposing scroll members in both radial and tangential directions over extended operating periods.

Yet another object of the invention is to provide such a scroll apparatus in which effective radial sealing is attained without excessive friction between the scroll members.

Still another object of the invention is to provide such a scroll apparatus wherein wear is essentially self compensating such that effective radial sealing is preserved.

Other objects and advantages of the invention will be apparent from the following description, the accompanying drawings and the appended claims.

DETAILED DESCRIPTION OF THE PREFERRED EMBODIMENT

Figure 1:
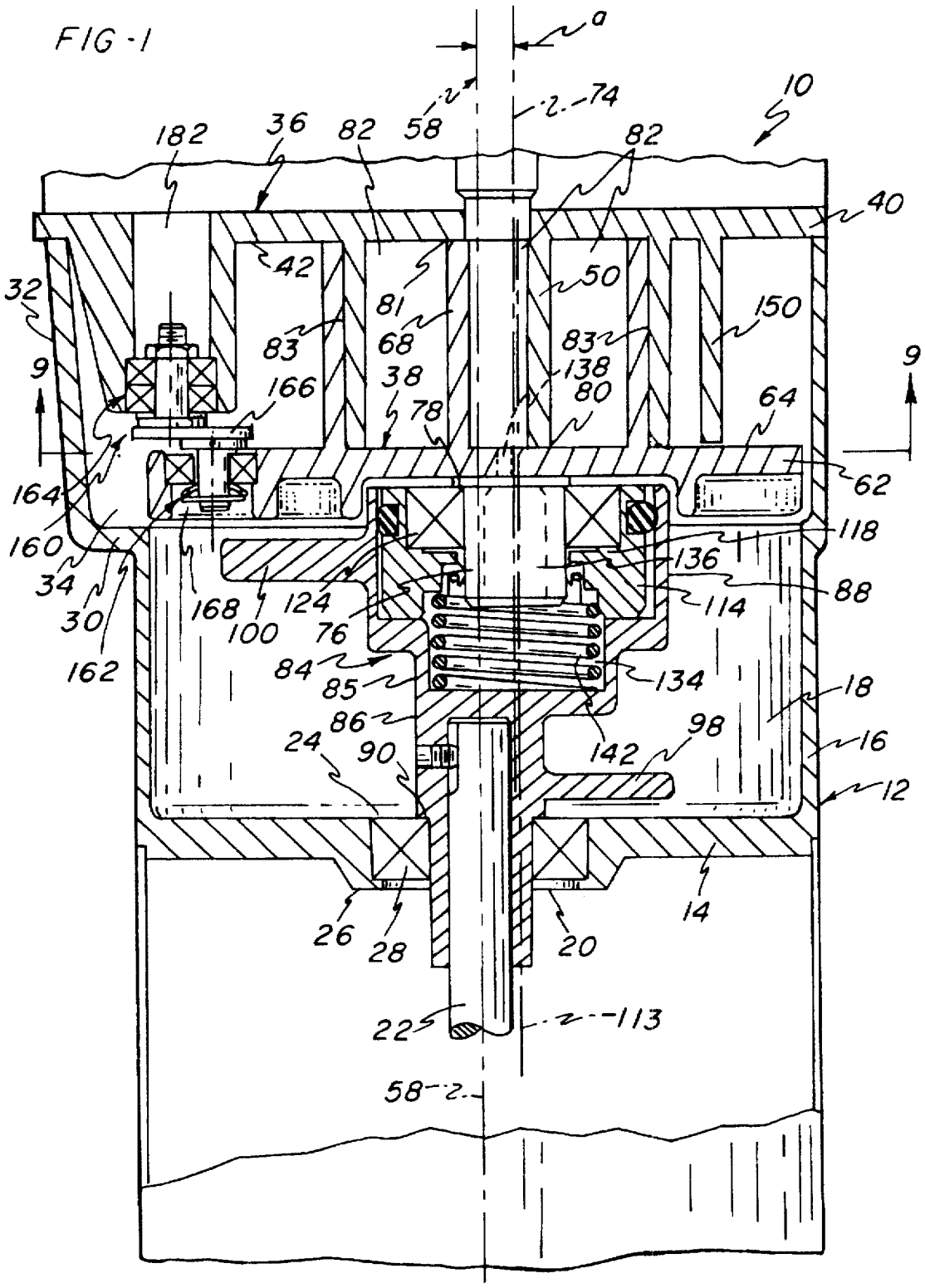
FIG. 1 is a cross-sectional view of the scroll fluid displacement apparatus of the present invention.
Figure 2:
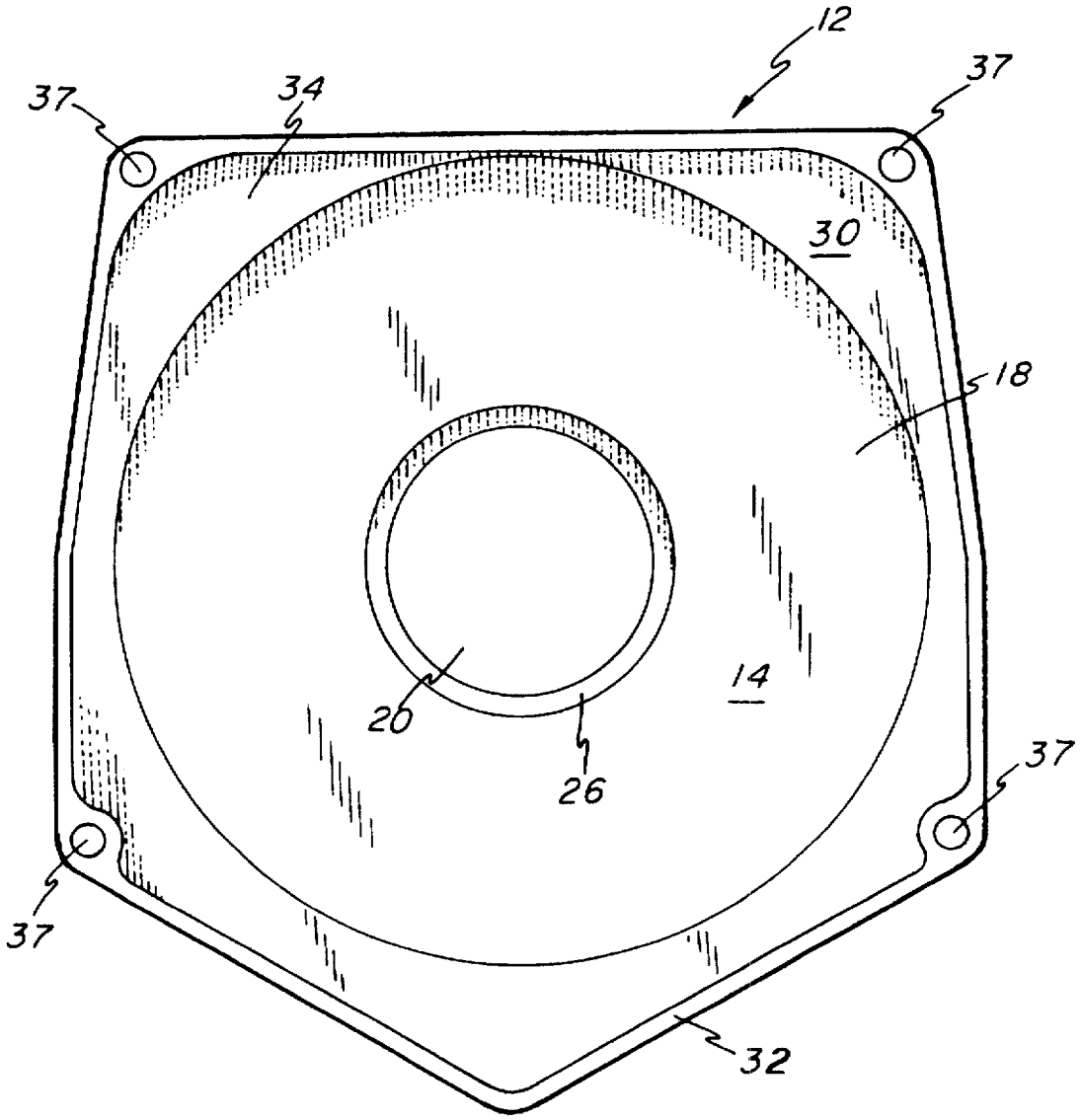
FIG. 2 is a top plan view of a housing of the scroll apparatus.

A scroll fluid displacement apparatus of the present invention in the form of a scroll compressor 10 is shown generally in FIG. 1. As mentioned above, while a scroll compressor will be used to illustrate the present invention, this in no way limits the invention and it is to be understood that the principle of this development will apply equally to other scroll fluid displacement apparatuses. Referring initially to FIGS. 1 and 2, the scroll compressor 10 includes a housing 12 having a first end wall 14 and a circumferential side wall 16 which extends upwardly from the first end wall 14 to define a first well 18. The first end wall 14 includes an opening 20 through which a motor shaft 22 extends. The opening 20 has a counterbore 24 defining a shoulder 26. A bearing 28 is received in counterbore 24 and seats against shoulder 26. Motor shaft 22 is mounted concentrically within bearing 28 and extends axially into the first well 18.

At the top of the first well 18, a peripheral floor 30 extends radially outwardly of wall 16. A peripheral wall 32 extends axially upwardly from floor 30 and defines a second well 34. Preferably, four threaded holes 37 are located at the top of the wall 32 at areas of enlarged wall thickness.

Figure 3:
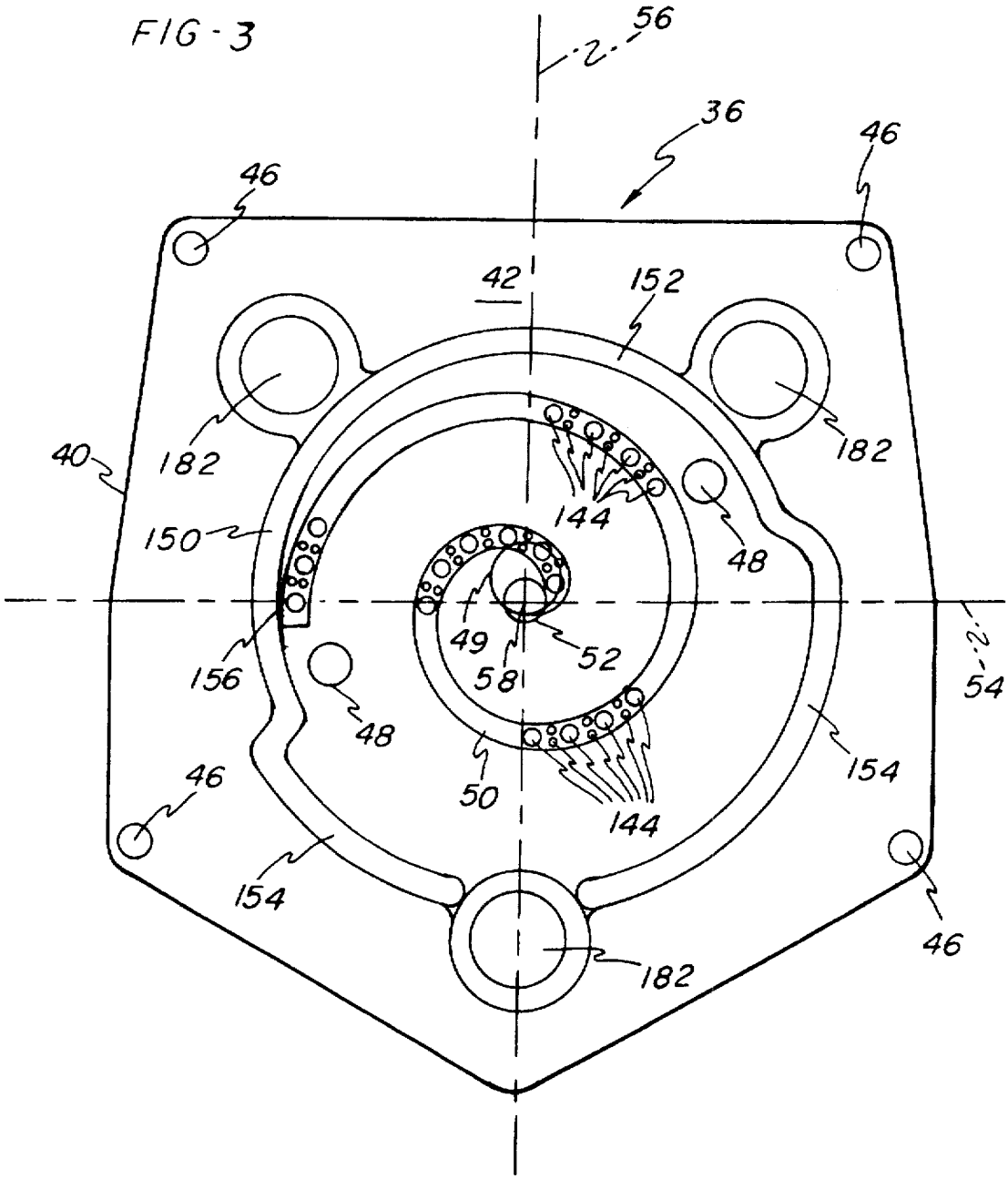
FIG. 3 is a plan view of an inboard surface of a stationary scroll member of the scroll apparatus.
Figure 4:
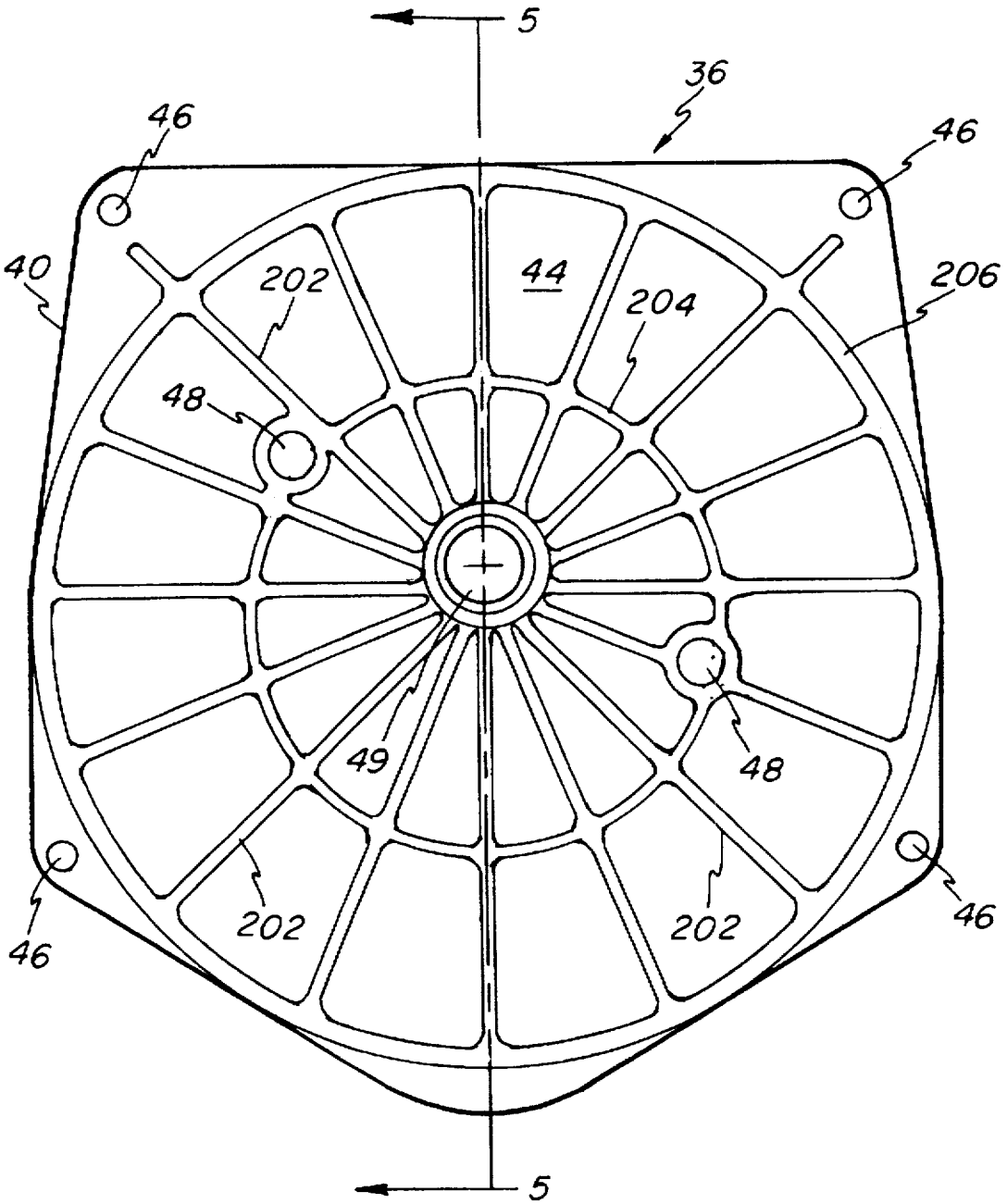
FIG. 4 is a plan view of an outboard surface of the stationary scroll member.
Figure 5:
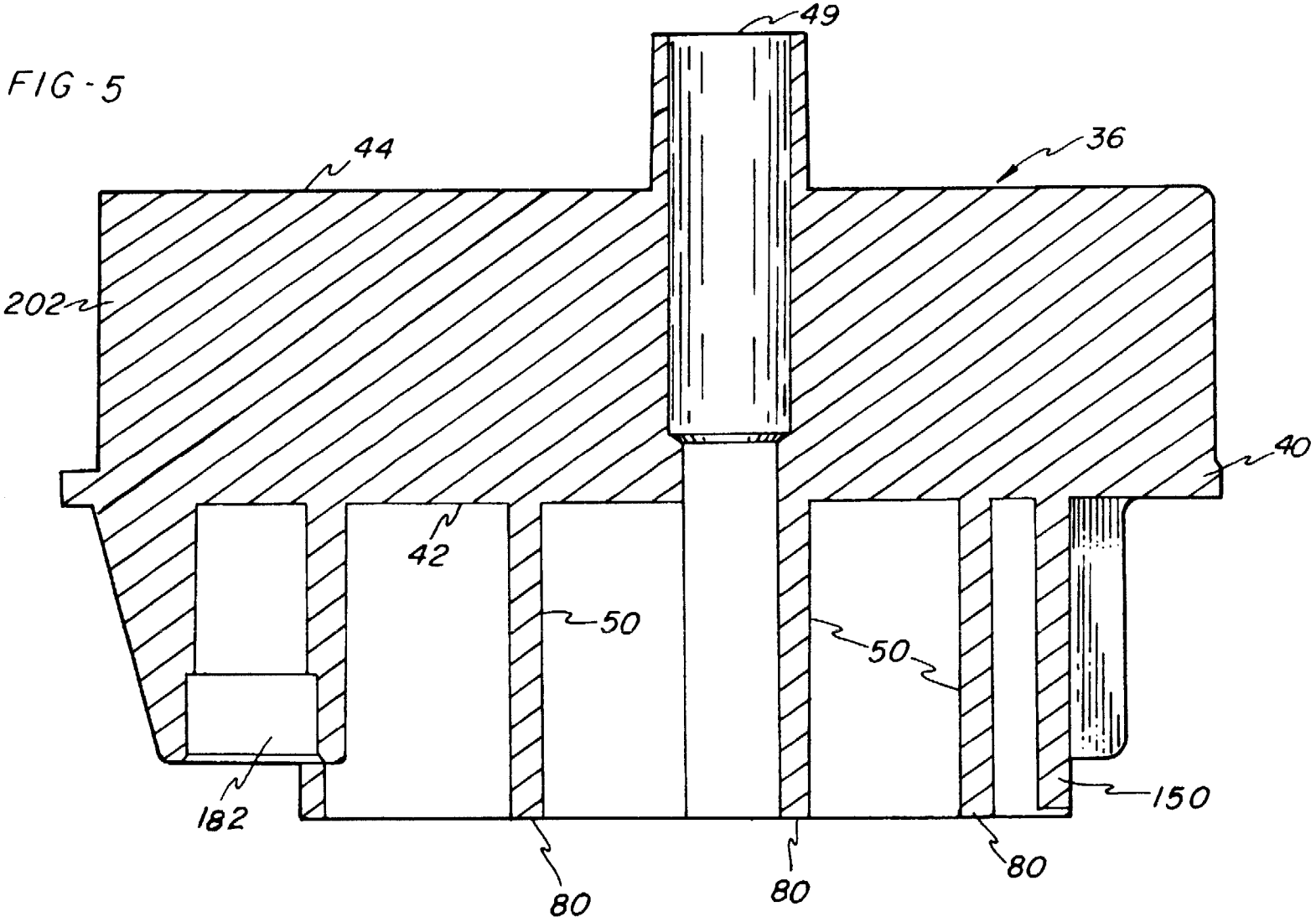
FIG. 5 is a cross-sectional view of the stationary scroll member taken along line 5—5 of FIG. 4.

A stationary scroll member 36 (FIGS. 3–5) and an orbiting scroll member 38 (FIGS. 6–8) are housed in the upper well 34 of the housing 12. Both scroll members 36 and 38 may be made from any near net shape method, but are preferably made of injection molded plastic. Additionally, while the improved sealing means of this invention are adapted for use with less accurate near net shape scroll members, the principles may find equal applicability with prior art machined metal scroll members or metal-plastic composite scroll members. Turning to FIGS. 3–5 the stationary scroll member 36 comprises a stationary plate 40 having an inboard surface 42 and an outboard surface 44. Preferably, four bolt holes 46 are located near the periphery of the stationary plate 40 and are aligned with the threaded holes 37 of the housing wall 32. Bolts (not shown) are passed through the respective holes 46 of the plate 40 to secure the stationary scroll member 36 to the housing 12. The stationary scroll member 36 further defines one or more fluid inlets 48 and a fluid outlet 49.

A stationary involute 50 having a predetermined thickness extends from the inboard surface 42 of the stationary plate 40. The stationary involute 50 is preferably molded integral with the stationary plate 40 thereby forming a single stationary scroll member 36. The stationary involute 50 is generated from a stationary base circle 52 of a predetermined radius and having an x-axis 54 and a y-axis 56. The intersection of the x-axis 54 and y-axis 56 define a z-axis or center axis 58 of the stationary involute 50. The stationary involute 50 is preferably aligned coaxially with the motor shaft 22 along the axis 58.

Figure 6:
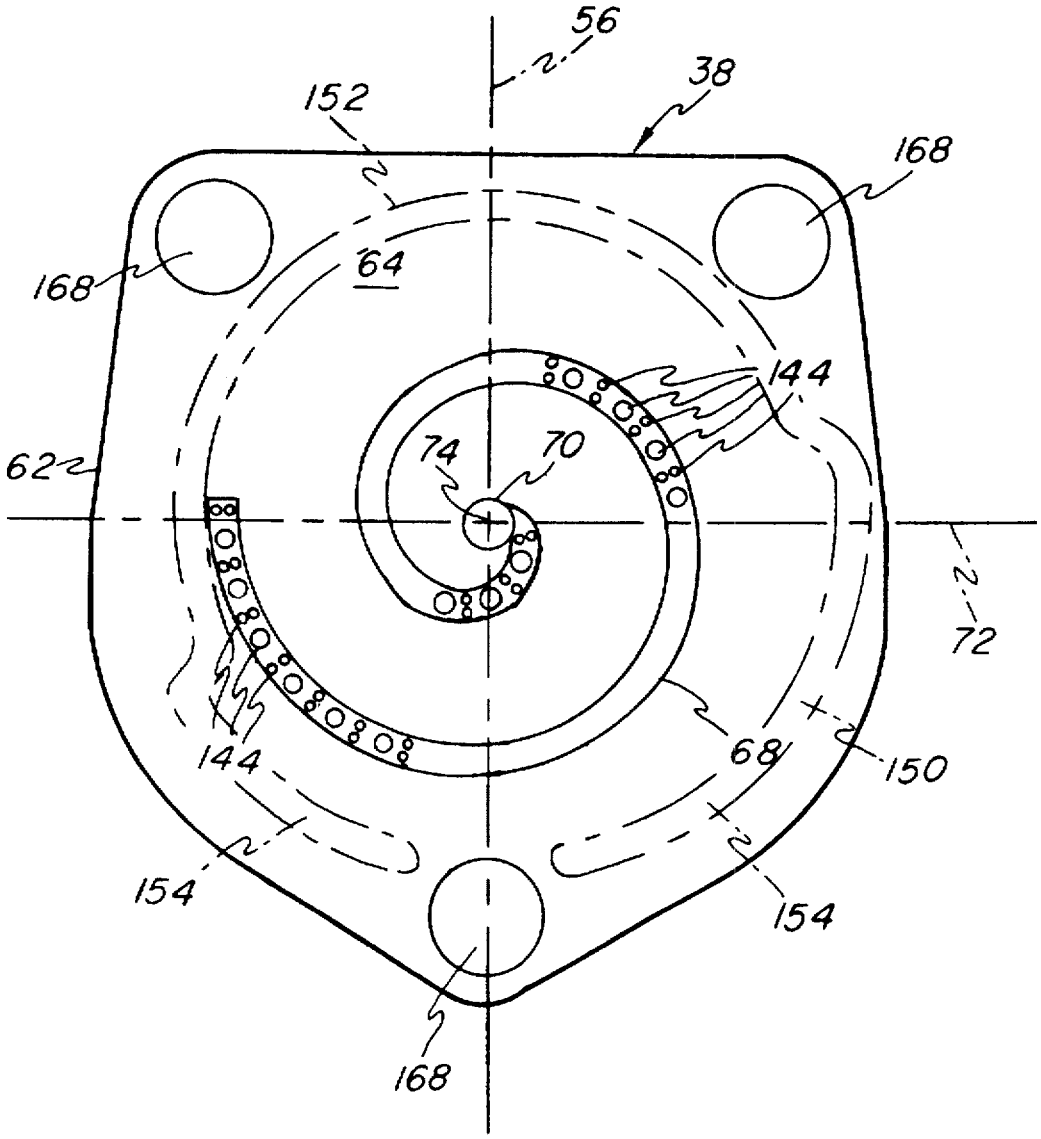
FIG. 6 is a plan view of an inboard surface of an orbiting scroll member of the scroll apparatus.
Figure 7:
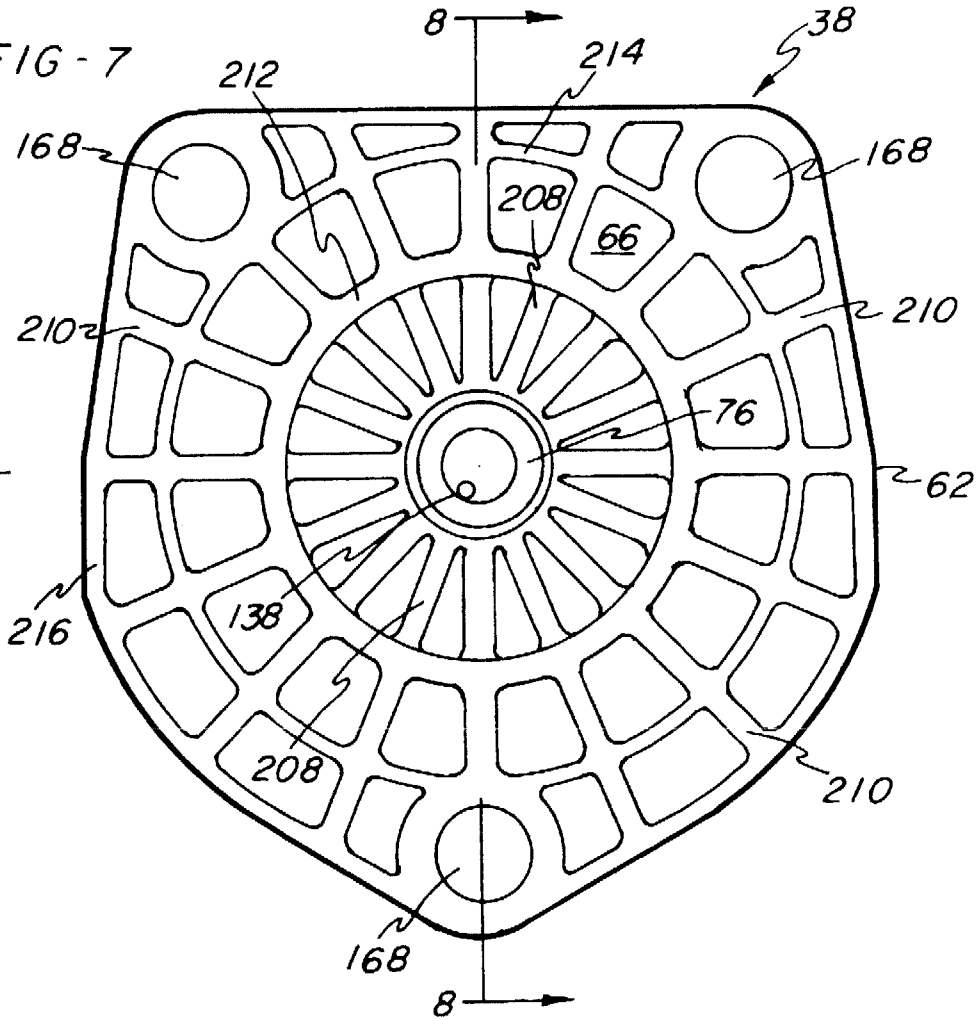
FIG. 7 is a plan view of an outboard surface of the orbiting scroll member.
Figure 8:
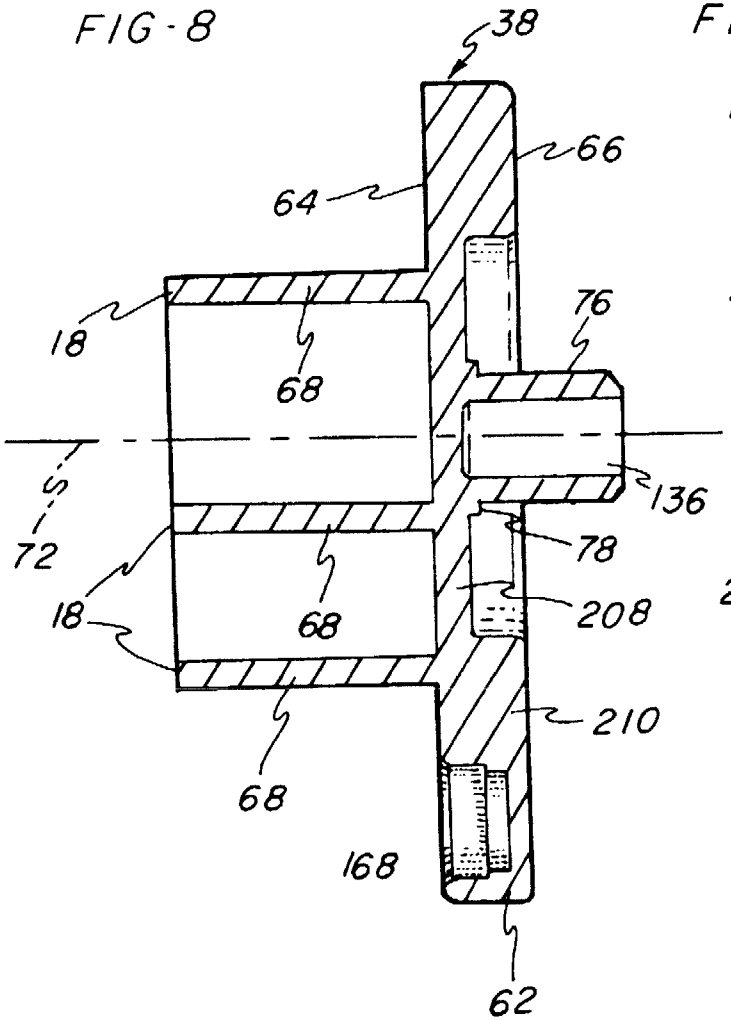
FIG. 8 is a cross-sectional view of the orbiting scroll member taken along line 8—8 of FIG. 7.

Turning now to FIGS. 6–8, the orbiting scroll member 38 includes an orbiting plate 62 having an inboard surface 64 and an outboard surface 66. An orbiting involute 68 having a thickness equal to that of the stationary involute 50 is molded integral with and extends from the inboard surface 64 of the orbiting plate 62. The orbiting involute 68 is generated from an orbiting base circle 70 having a radius equal to that of the stationary base circle 52 which is used to generate the stationary involute 50. The distance between corresponding points of adjacent wraps of each involute is equal to the circumference of the respective generating circle 52, 70. This distance is also called the pitch of the involute. It should therefore be apparent that the pitch of both involutes 50 and 68 are the same. However, the orbiting involute 68 is maintained 180° out of phase from the stationary involute 50 and then radially offset so that at least one pair of contact points are defined between the involutes 50 and 68 along a radius extending from the central region of the involutes. The orbiting base circle 70 therefore has the same y-axis 56 as the stationary base circle 52 but an x-axis 72 separated from the stationary involute x-axis 54 by a distance "t" (FIG. 9) The intersection of the x-axis 72 and y-axis 56 define a z-axis or center axis 74 of the orbiting involute 68. The distance "t" defines the distance between the two center axes 58, 74 of the involutes 50, 68. (FIG. 9) This distance is also known as the "theoretical eccentric" between the involutes and is calculated by the equation $t=(p/2)-I$, wherein t equals the theoretical eccentric, p equals the involute pitch, and I equals the involute thickness.

A scroll shaft 76 extends from the outboard surface 66 of the orbiting plate 62 and has a longitudinal axis which is disposed coaxially with the center axis 74 of the orbiting involute 68. A shoulder 78 is formed at the base of the scroll shaft 76 adjacent the outboard surface 66.

Figure 9:
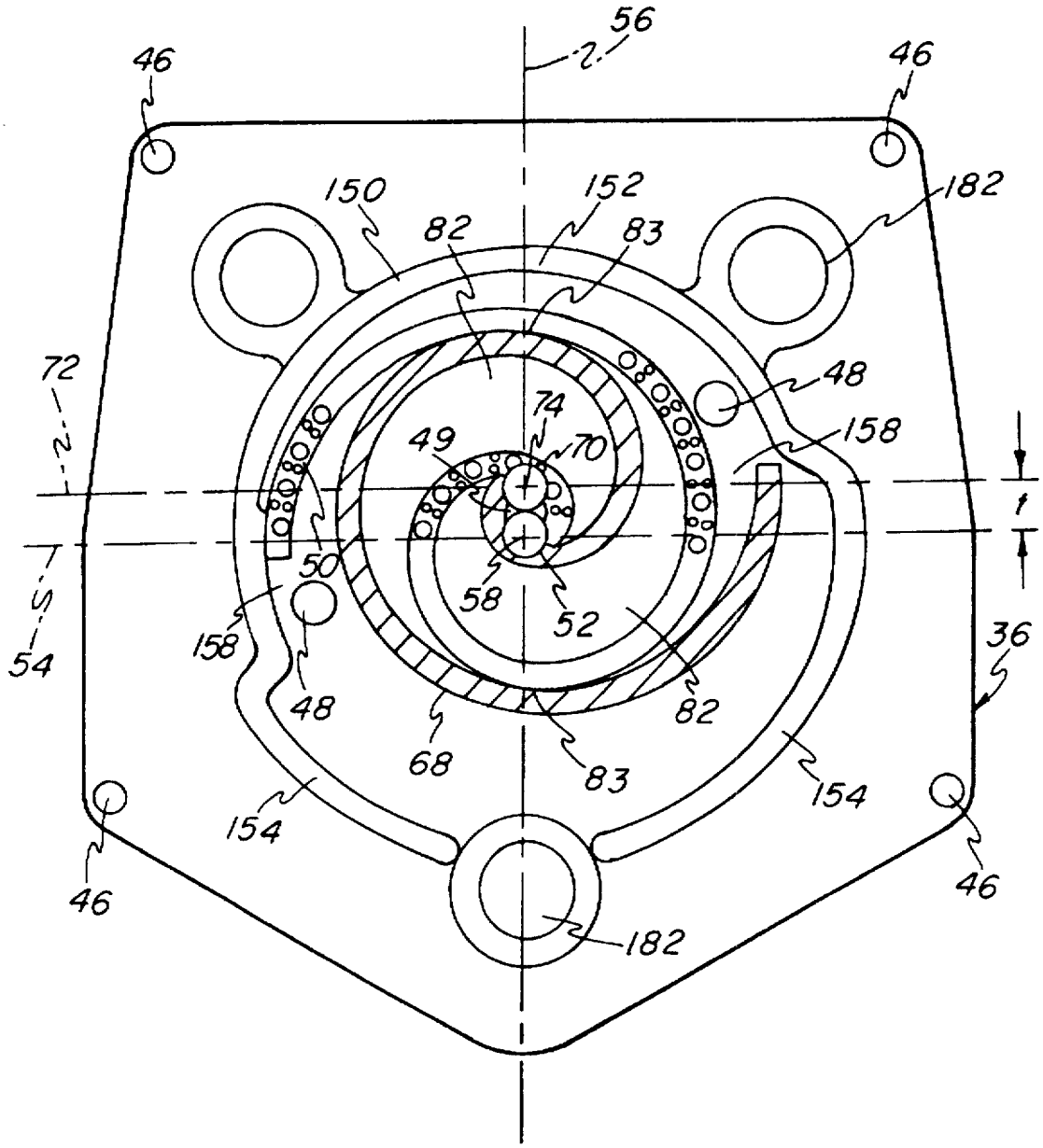
FIG. 9 is a cross-sectional view taken along line 9—9 of FIG. 1 showing the interaction between the involutes of the scroll members.

Referring to FIGS. 1 and 9, the inboard surface 64 of the orbiting plate 62 is adapted to form a radial seal with a tip surface 80 of the stationary involute 50. In like manner, a tip surface 81 of the orbiting involute 68 is adapted to form a radial seal with the inboard surface 42 of the stationary plate 40. One or more fluid pockets 82 exist within the volume defined between plates 40 and 62 as the involutes make radial contact with each other at points 83. It is therefore apparent that achieving axial contact between the involute tips 80, 81 and the plate 62, 40 of the opposing scroll member 38, 36 seals against radial leakage and attains radial sealing. Likewise, the achieving of radial contact between the involute sides as they make moving contact as the orbiting scroll member 38 is orbited seals against tangential leakage and hence achieves tangential sealing.

Figure 10:
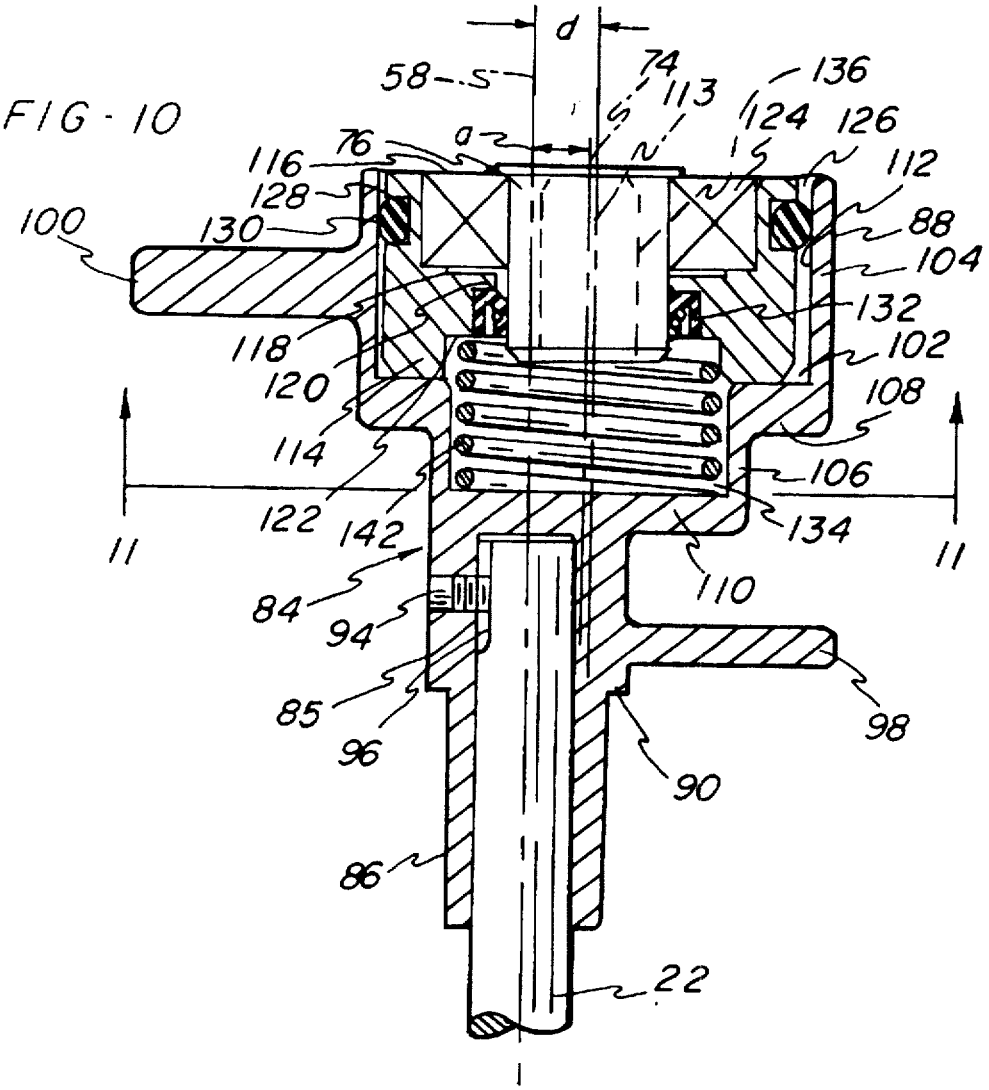
FIG. 10 is an enlarged cross-sectional view of the drive shaft of the scroll apparatus.
Figure 11:
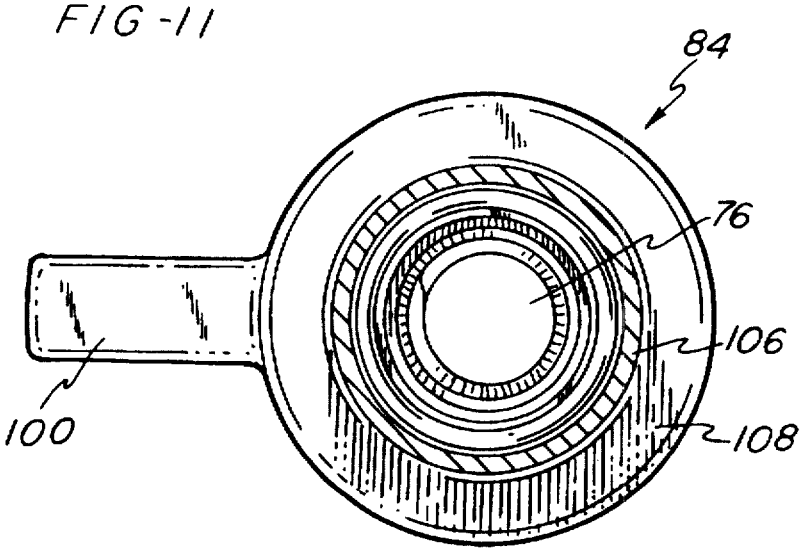
FIG. 11 is a cross-sectional view of the drive shaft taken along line 11—11 of FIG. 10.

Turning now to FIGS. 1 and 10, the orbiting scroll member 38 is orbitally driven by a drive shaft 84 including a shaft support member 85 having first and second portions 86, 88. The first portion 86 is journaled within bearing 28 which seats against a shoulder 90. The first portion 86 receives the motor shaft 22 which is preferably disposed coaxially to the center axis 58 of the stationary involute 50. The drive shaft 84 is fixed to the motor shaft 22 by means of a set screw 94 extending radially through the shaft support member 85 and engaging a bearing surface 96 on the motor shaft 22. A balancing counterweight 98 is integrally formed with the drive shaft 84 for minimizing vibration in the apparatus. A second counterweight 100, integral with the second portion 88, provides both static and dynamic balancing of the inertial forces produced by the motion of the orbiting scroll member 38.

Referring to the preferred embodiment as shown in FIG. 10, the second portion 88 of the drive shaft support member 85 further includes a second bore 102 having an outer cylindrical wall 104, an inner cylindrical wall 106, a connecting wall 108, and an end wall 110, all of which collectively define an inner surface 112. The second bore 102 further defines a longitudinal axis 113 of the second portion 88 and bore 102.

A ring piston 114 is received within the second bore 102 and adapted for axial movement along, and radial compliance with, the inside surface of the outer cylindrical wall 104. The ring piston 114 defines a central through bore 116 which is counterbored to form a bearing shoulder 118, a sealing shoulder 120, and a spring engaging shoulder 122. A bearing 124 is received within the bore 116 and seats on bearing shoulder 118. The scroll shaft 76 which extends from the orbiting scroll member 38 is journaled in the bearing 124 wherein the orbiting scroll member 38 can rotate with respect to the drive shaft 84 as the motor shaft 22 is rotated by a standard motor (not shown).

As described above, the motor shaft 22 is preferably coaxial to the stationary involute center axis 58, while the scroll shaft 76 is mounted concentric to the orbiting involute center axis 74. The drive shaft 84 separates the motor shaft 22 from the scroll shaft 76 by a distance identified as an actual eccentric "a" which is not equal to the theoretical eccentric "t". As described above the theoretical eccentric "t" is the distance between the involute center axes 58, 74 when the involutes 50, 68 are in a meshing relationship. The difference between the actual eccentric "a" and theoretical eccentric "t" causes the drive shaft 84 to generate a force acting radially, generally along a radius defined by the stationary involute center axis 58 and scroll shaft axis 77.

An actual eccentric "a" greater than the theoretical eccentric "t" generates a radially outwardly acting force which causes the orbiting involute 68 to be loaded against the stationary involute 50 for attaining effective tangential sealing. If the actual eccentric "a" is defined to be less than the theoretical eccentric "t" then a radially inwardly acting force is created which opposes a portion of the centrifugal force that is generated when the orbiting scroll member 38 orbits. The reduced centrifugal force results in a reduced contact force between the orbiting involute 68 and stationary involute 50 and therefore less friction and wear. While it is to be understood that the actual eccentric "a" may be less than or greater than the theoretical eccentric "t", the following detailed description will assume that the preferred embodiment is where the actual eccentric "a" is defined to be greater than the theoretical eccentric "t". The only difference between the alternative actual eccentrics "a" is the direction of the resulting radially acting force. It will be apparent from the following description that the operation of the scroll apparatus 10 will otherwise be the same.

Referring again to FIG. 10, the drive shaft support member 85 is constructed such that the first portion 86 is coaxial to the axis 58 and is separated from the axis 113 of the second portion 88 by a drive shaft eccentric "d" which is not equal to the theoretical eccentric "t". The bore 102 is concentric within the second portion 88. The outer wall 104 has an inner diameter greater than the outer diameter of the piston 114, thereby defining a circumferential gap 126 therebetween. The gap 126 is larger than the difference between the drive shaft eccentric "d" and the theoretical eccentric "t" wherein the piston 114 will not engage the inner surface of the outer wall 104 when located concentric to the scroll shaft 76.

The piston 114 is contoured to define a peripheral groove 128 suitable for positioning a resilient compressible member 130 between the piston 114 and the outer wall 104 of the drive shaft 84. The resilient compressible member 130 is preferably an o-ring and serves to fill the gap 126 between the piston 114 and the outer wall 104 thereby providing radial compliance to the orbiting scroll member 38.

In the preferred embodiment, the drive shaft eccentric "d" between the motor shaft axis 58 and the drive shaft axis 113 is greater than the theoretic eccentric "t" defined by orbiting involute axis 74 and the stationary involute axis 58, wherein the support member 85 will exert a force against the resilient compressible member 130 outwardly approximately along a radius formed by the motor shaft axis 58 and drive shaft axis 113. This force will be transferred through the piston 114 and the bearing 124 to the scroll shaft 76. The scroll shaft 76 will therefore be forced outwardly in the direction of the axis 113 of the bore 112 in an attempt to conform the theoretical eccentric "t" with the drive shaft eccentric "d". Since the scroll shaft 76 is connected to the orbiting scroll member 38 coaxially to the orbiting involute center axis 74, an actual eccentric "a" will be defined between the orbiting involute center axis 74 and stationary involute center axis 58 which is greater than the theoretical eccentric "t". The actual eccentric "a" will be less than the drive shaft eccentric "d" because of the presence of the resilient compressible member 130 which assumes a portion of the eccentric as it is compressed. As the scroll shaft 76 is forced outwardly into conformance with the actual eccentric "a", the orbiting involute 68 will be loaded against the stationary involute 50 thereby creating a tangential sealing relationship.

In an alternative embodiment, the actual eccentric "a" between the motor shaft axis 58 and the drive shaft axis 113 is defined to be less than the theoretical eccentric "t". The support member 85 will therefore exert a force against the resilient compressible member 130 inwardly approximately along a radius formed by the motor shaft axis 58 and drive shaft axis 113. The inwardly acting force will be transferred through the piston 114 and the bearing 124 thereby forcing the scroll shaft 76 inwardly towards the axis 113 of the bore 112 thereby defining the actual eccentric "a". The scroll shaft 76 will transfer the inwardly acting force to the orbiting involute 68. The inwardly acting force will oppose a portion of the centrifugal force generated by the orbiting scroll member 38 as it orbits. The reduced centrifugal force will lessen the contact force between the involutes 68 and 50 thereby reducing the resulting friction and wear while maintaining sufficient contact force for effective tangential sealing.

A sealing member 132 is supported on the sealing shoulder 120 of the piston 114 for sealingly engaging the scroll shaft 76. A pressurizable fluid chamber 134 is defined by the piston 114, the sealing member 132, the resilient compressible member 130, the scroll shaft 76, and the inner surface 112 of the drive shaft 84. A bore 136 within the scroll shaft 76 and a fluid port 138 within the orbiting plate (FIG. 1) provide fluid communication between the fluid pocket 82 of highest pressure and the pressurizable fluid chamber 134. (FIG. 1).

Inasmuch as the orbiting scroll member 38 is not rigidly connected to the drive shaft 84 it is apparent that it is free to move axially, i.e., to "float." The scroll shaft 76 is free to move axially within the drive shaft 84 in reaction to movement of the piston 114. By bleeding high pressure fluid from the fluid pockets 82 defined by the scroll members 36 and 38 through the fluid port 138 and bore 136 and into the pressurizable fluid chamber 134 an axial force, which is a function of the internal gas pressure of the fluid pocket 82, is provided against the piston 114. In effect, the fluid pressure within the pressurizable fluid chamber 134 forces the orbiting scroll member 38 away from the drive shaft 84 and against the stationary scroll member 36 to achieve effective sealing between the involute tips 80, 81 and the opposing scroll member plates 62, 40.

It is desirable to bias the axial force by means of a preloading spring 142 so that the total axial force does not go to zero even should the fluid pocket pressure in the system go to zero. The spring 142 is designed to exert an axial force on the orbiting scroll member at those times when the internal fluid pocket pressure and hence the axial force produced thereby is zero. The preloading spring 142 is positioned such that it contacts the spring engaging shoulder 122 of the piston 114 at one end and the end wall 110 at its opposite end. The axial force exerted by the spring 142 is a function of its spring constant and the position of the piston 114. The spring 142 provides an axial sealing force at start up and some additional axial sealing force during operation.

As apparent from viewing FIG. 1, the combined axial force of the fluid pressure and spring 142 causes the piston 114 to move axially towards the orbiting scroll member 38. Bearing shoulder 118 of the piston 114 will move the bearing 124 into engagement with the shoulder 78 of the scroll shaft 76, thereby forcing the orbiting scroll member 38 into radial sealing engagement with the stationary scroll member 36. The axial sealing force is used to force the scroll plates 40 and 62 into sealing contact with the tips 81 and 80 of the opposing scroll member 38 and 36 to seal the fluid pockets 82 at these areas of contact. The desired radial sealing is achieved through the use of the drive shaft 84 in conjunction with the orbiting scroll member 38 which is allowed to "float" under the influence of forces upon it. The orbiting scroll member 38 moves under the axial forces upon it until there is sufficient contact to efficiently seal the pockets. As the pressure within the fluid pockets 82 increases, the axial sealing force will also increase as the increased pressure is communicated to the pressurizable fluid chamber 134 through the fluid port 138 and bore 136.

Figure 12:
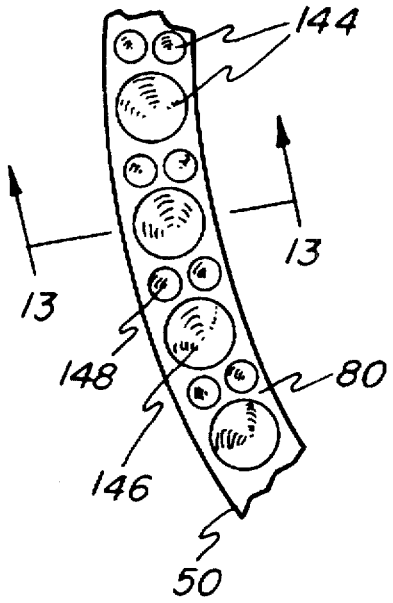
FIG. 12 is an enlarged plan view of a portion of an involute illustrating recessed portions of an involute tip.
Figure 13:
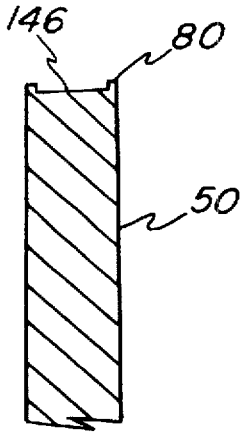
FIG. 13 is an enlarged cross-sectional view of the involute taken along line 13—13 of FIG. 12.

As mentioned above, the axial force produced by the fluid pressure and spring 142 within the pressurizable fluid chamber 134 of the drive shaft 84 causes the orbiting scroll member 38 to achieve radial sealing contact with the stationary scroll member 36. The tips 80 and 81 of the involutes 50 and 68 sealingly engage the plates 62 and 40 of the opposing scroll members 38 and 36. Referring to FIGS. 12–13, the tip surfaces 80 and 81 of both involutes 50 and 68 are provided with recessed portions 144 to facilitate tip surface wear when the scroll compressor 10 is initially operated. While the recessed portions 144 extend along the entire length of both involutes 50 and 68, a representative section of the stationary involute 50 is illustrated in FIGS. 12–13. It is to be understood that the tip surface 81 and recessed portions 144 of the orbiting involute 68 are identical in structure to that of the stationary involute 50. By reducing the overall tip surface contacting the opposing scroll plate, involute wear is accelerated resulting in improved radial sealing.

The recessed portions 144 may be defined by any geometric shape or texture, however for illustrative purposes the recesses are shown to be cylindrical in FIG. 12. In the preferred embodiment, cylindrical bores 146 having large diameters are interposed between two cylindrical bores 148 having a reduced diameter. As illustrated in FIG. 13, the recessed cylindrical bores 146 and 148 have a limited depth as measured from the tip surface, typically less than 1% of the overall involute height. As the surfaces of the tips 80 and 81 wear and the involute height reduced, radial sealing contact is maintained due to the ability of the orbiting scroll member 38 to float under the force of the pressure of the fluid in the pressurizable fluid chamber 134. The extent of accelerated tip surface wear is restricted by the above mentioned limited depth of the recessed portions 144 and by a raised stabilizing surface 150 extending from the inboard surface 42 of the stationary plate 40 as illustrated in FIG. 3. Preferably, the stabilizing surface 150 is integral with the stationary scroll member 36 and has a height slightly less than that of the stationary involute 50. Alternatively, the stabilizing surface 150 may extend from the inboard surface 64 of the orbiting plate 62 as illustrated in FIG. 6.

Referring again to FIG. 3, the stabilizing surface 150 comprises an inner circumferential member 152 connected to a pair of outer circumferential members 154. The inner circumferential member 152 has a radius defined by the stationary involute 50 wherein the inner circumferential member 152 is molded integral with the end of the stationary involute 50 at point 156. The outer circumferential members 154 each have a radius defined so as to clear the path of the orbiting involute 68 as it orbits relative to the stationary involute 50. After initial compressor use and the resultant involute tip surface wear, the stabilizing surface 150 will contact the orbiting plate 62. The additional wear surface provided by the stabilizing surface 150 will serve to retard the continued wear of the involute tips 80, 81.

As described above, the two involutes 50, 68 are maintained 180° out of phase from each other, as seen in FIG. 9. As is known, when the orbiting involute 68 is driven in orbiting motion by the drive shaft 84, the fluid pockets 82 are moved from suction zones 158 near the inlets 48 toward the center of the involutes 50 and 68. As the fluid pockets 82 are moved toward the center of the involutes 50 and 68, they are reduced in size to compress the fluid contained within the pockets 82. The fluid is then forced out of the compressor 10 through the outlet 49.

Turning again to FIG. 1, at least two idler crank assemblies 160 are preferably provided to maintain the 180° phase relationship between the scroll members 36 and 38. Each idler crank assembly 160 is adapted for axial compliance and extends between the stationary scroll member 36 and the orbiting scroll member 38. Each idler crank assembly 160 includes a first idler crank 162 and a second idler crank 164 which are connected to opposite sides of a plate 166 and off-set from each other. The offset is equal to the actual eccentric "a" defined by the drive shaft 84, as described above.

Figure 14:
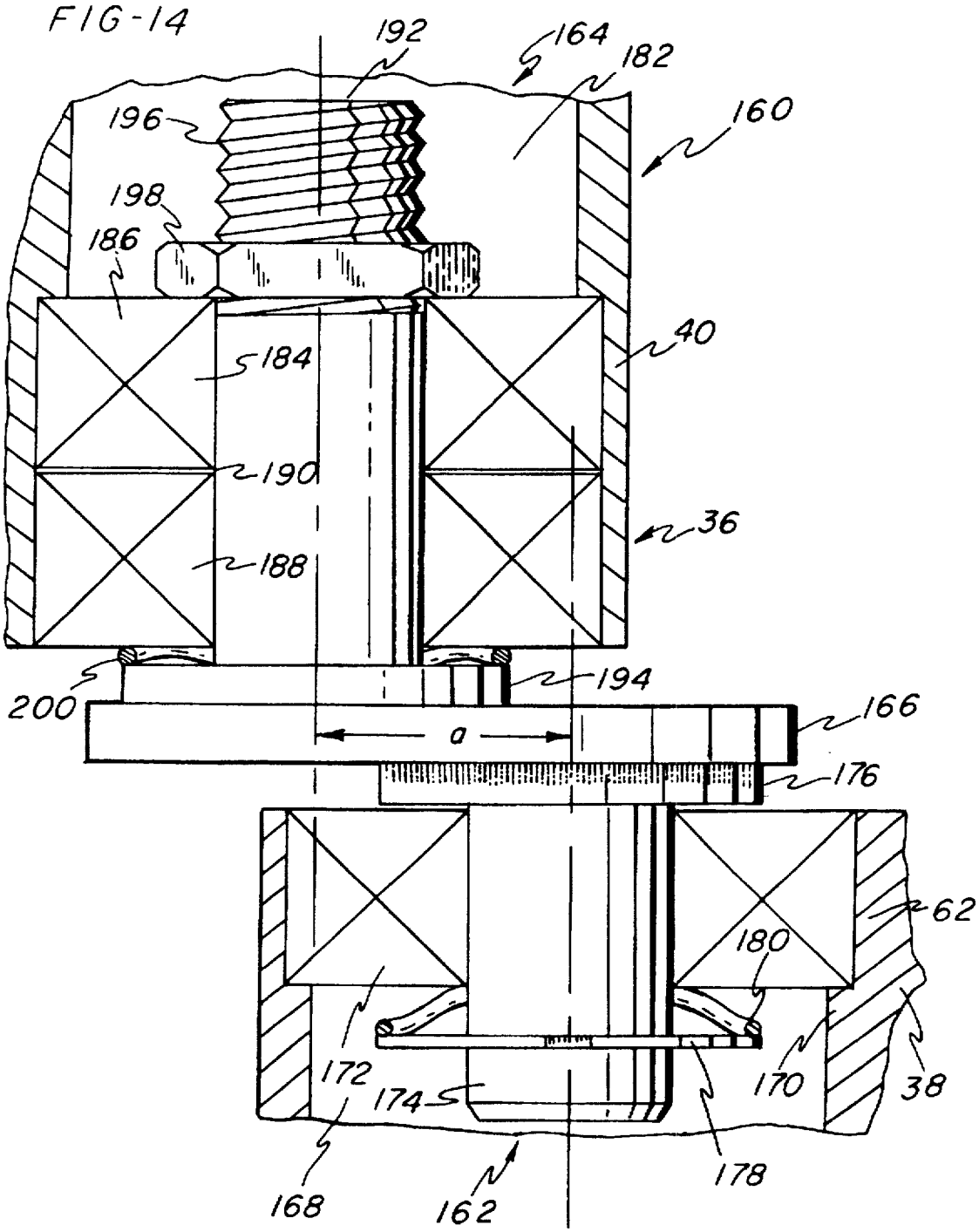
FIG. 14 is an enlarged view of an idler crank assembly of the scroll apparatus of FIG. 1.

Turning now to FIG. 14, the idler crank assembly 160 is shown in greater detail. The first idler crank 162 is received in a bore 168 having a shoulder 170 formed at the outboard side of the orbiting scroll member 38. A radial load support bearing 172 is received in bore 168 and is seated against the shoulder 170. A first crank shaft 174 is journaled in the bearing 172. The shaft 174 preferably has a head 176 which is positioned at the inboard side of the orbiting plate 62. A stop member 178 is positioned proximate the opposite end of the shaft 174 for retaining a spring 180. The stop member 178 is preferably a snap ring engaging a circumferential slot on the shaft 174. For preloading the bearing 172, a wave or other spring washer may be used as the spring 180 and is positioned between the stop member 178 and the bearing 172.

Figure 15:
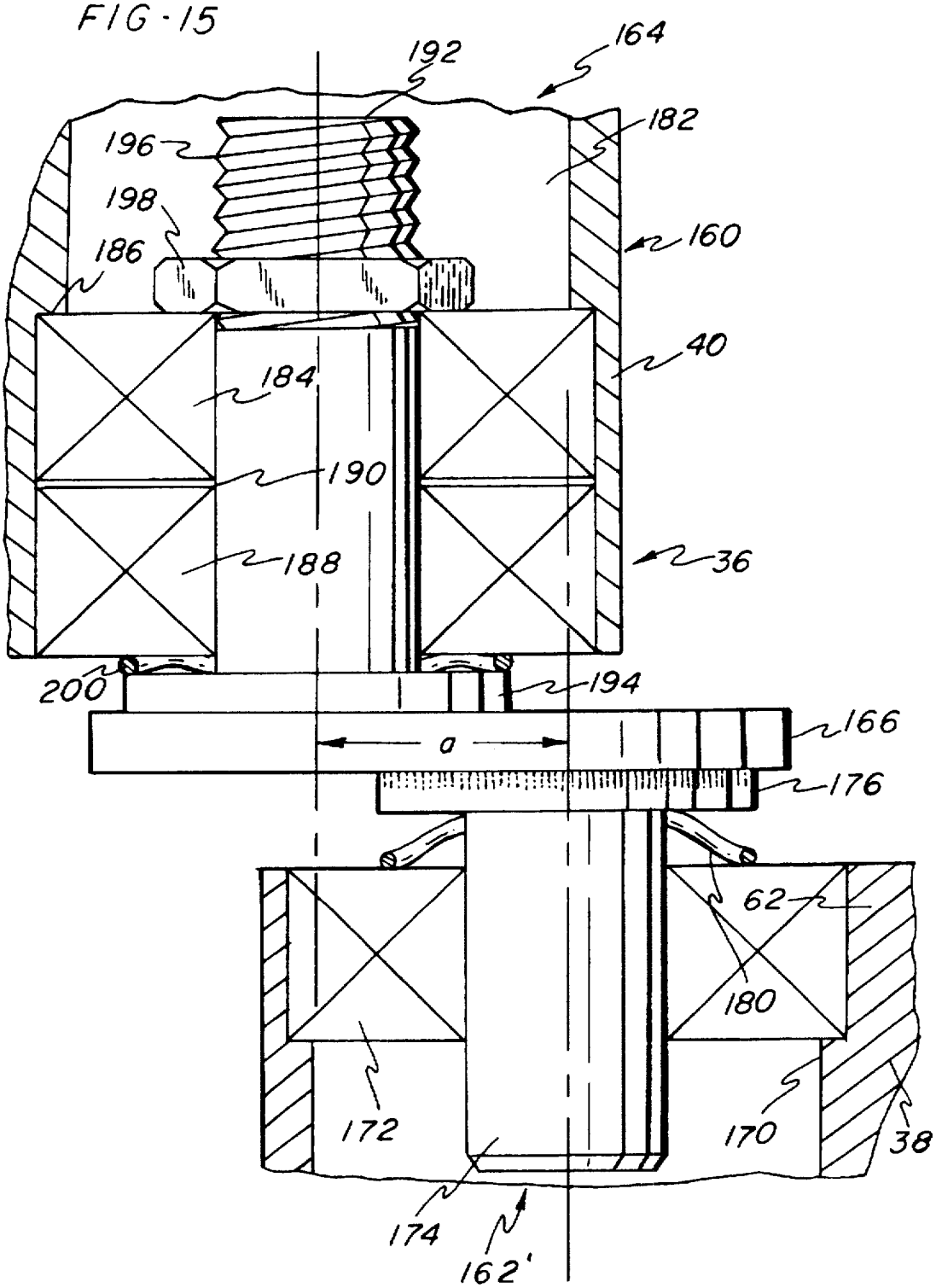
FIG. 15 is an enlarged view of an alternative embodiment of the idler crank assembly of FIG. 14.

As shown in FIG. 15, the first idler crank 162' may exclude the stop member 178 wherein the spring 180 is retained on the first crank shaft 174 between the head 176 and bearing 172. It may be observed that the crank shaft 174 is not axially fixed to the orbiting scroll member 38 wherein the orbiting scroll member 38 is allowed to float about the first idler crank 162 or 162'. The axial compliance of the first idler crank 162 and 162' permits the orbiting scroll member 38 to move freely in an axial direction for radially sealing with the stationary scroll member 36.

The second idler crank 164 is received in bore 182 defined in the stationary plate 40. An outboard radial load supporting bearing 184 is received in bore 182 and seats against a shoulder 186. An inboard radial load supporting bearing 188 is received in bore 182 adjacent the outboard radial load supporting bearing 184. Bearings 184 and 188 are spaced apart by a thin shim 190. A second crank shaft 192 is journaled in bearings 184 and 188. The second crank shaft 192 has a head 194 at one end which is positioned at the inboard side of the stationary scroll member 36. The opposite end of the second crank shaft 192 has a threaded portion 196 for engaging a nut 198. The nut 198 is threaded onto the threaded portion 196 to hold the second crank shaft 192 in the bearings 184 and 188. A wave or other spring washer 200 is positioned between the head 194 and outboard bearing 184. The spring washer 200 preloads the bearings 184 and 188 of the second idler crank 164.

The spring washers 180 and 200 serve to preload the bearings 172 and 184, 188. The pre-loading takes out all internal clearances in the bearings, eliminating the need for expensive precision bearings. No thrust bearings are needed in the idler crank assemblies 160 since no thrust loads will be incurred by the idler crank assemblies 160. All thrust forces will be exerted against bearing 124 located within the drive shaft 84. (FIG. 1).

As seen in FIG. 14, the first crank 162 is secured adjacent one edge of the plate 166 and the second crank 164 is fixed adjacent the diameterically opposing edge of the plate 166. The off-set between the two cranks 162 and 164 is equal to the actual eccentric "a" which is, as described above, the distance between the motor shaft axis 58 and the axis 113 of the second portion 88 of the drive shaft 84. Because the two cranks 162 and 164 are fixed to the plate 166, the orbiting motion of the orbiting scroll member 38 is passed to the first crank 162. The first crank 162 will therefore orbit around the second crank 164. In addition, the orbiting scroll member 38 is free to move axially relative to the first crank 162, permitting floating motion of the orbiting scroll member 38 for improved radial sealing.

Referring again to FIGS. 4–5 and 7–8, both orbiting and stationary scroll members 38 and 36 are provided with ribs on their outboard surfaces 66 and 44 for strength and heat dissipation. Turning now to FIGS. 4 and 5, radial ribs 202 extend in a radial direction generally from a point proximate the center of the outlet 49. Preferably, sixteen ribs 202 are evenly spaced around the outboard surface 44 of the stationary plate 40. Inner and outer rib rings 204 and 206 join the radial ribs 202. The radial ribs 202 extend around the circumference of the inlets 48.

As illustrated in FIGS. 7 and 8, inner radial ribs 208 and outer radial ribs 210 are radially disposed outwardly from the scroll shaft 76. Preferably, sixteen of both the inner radial ribs 208 and the outer radial ribs 210 are equally spaced about the scroll shaft 76. The inner radial ribs 208 have a height less than the shoulder 78 of the scroll shaft 76 thereby providing clearance for the bearing 124. (FIG. 1). The outer radial ribs 210 have a height greater than that of the inner ribs 208 to increase the area available for heat transfer. The outer radial ribs 210 extend around the circumference of the bores 168. Inner and outer rib rings 212 and 214 connect the outer radial ribs 210. A peripheral rib 216 joins the outer radial ribs 210 at the outer periphery of the orbiting scroll member 38. The ribs provide for efficient heat dissipation during the operation of the compressor while also stiffening the scroll members. As described above, each scroll member including ribs, is preferably formed as a single molded plastic part.

Figure 16:
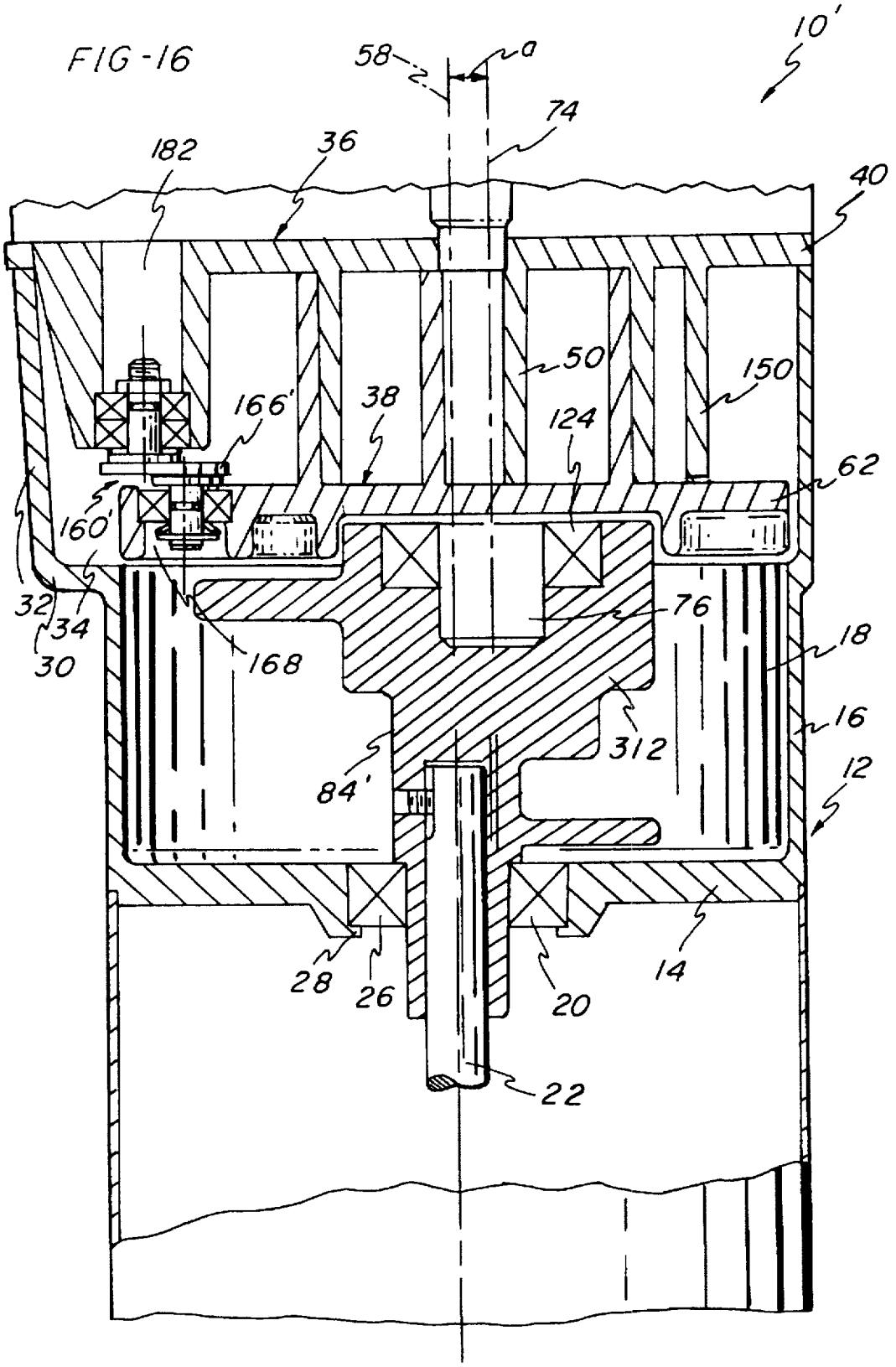
FIG. 16 is a cross-sectional view of an alternative embodiment of the scroll fluid displacement apparatus of the present invention.
Figure 17:
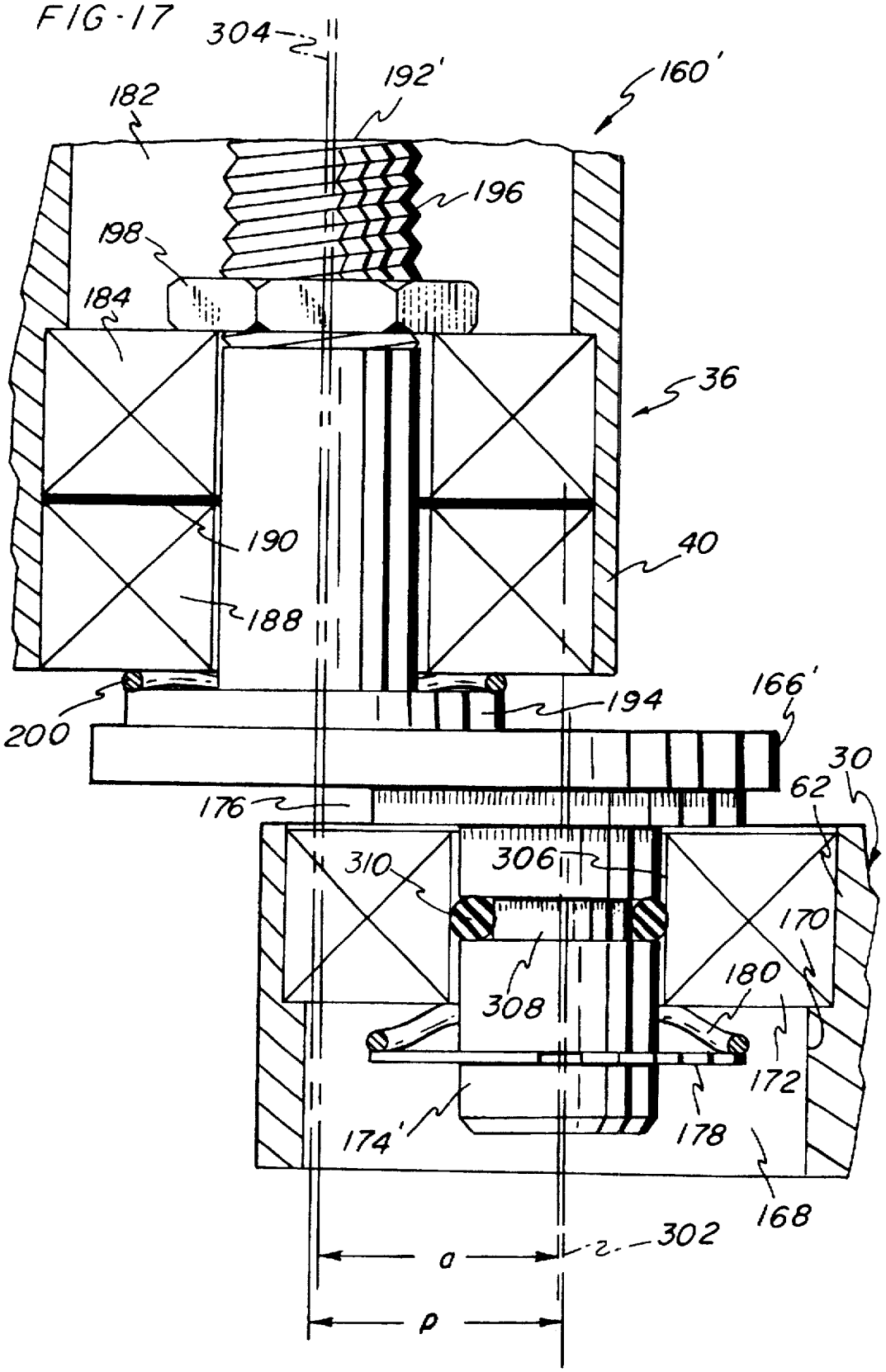
FIG. 17 is an enlarged view of an idler crank assembly of the scroll apparatus of FIG. 16.

An alternative embodiment of the scroll compressor 10' of the present invention is illustrated in FIGS. 16 and 17 in which like reference numerals are used to refer to like components shown in FIGS. 1–15. In this embodiment, the actual eccentric "a" between the involute center axes 74 and 58 is defined by the idler crank assemblies 160' rather than by the drive shaft 84'. Additionally, each idler crank assembly 160' is adapted for radial compliance.

Referring to FIG. 17 in greater detail, the plate 166' is constructed such that the axis 302 of the first crank shaft 174' is separated from the axis 304 of the second crank shaft 192' by a plate eccentric "p" which is not equal to the theoretical eccentric "t". The first crank shaft 174' has an outer diameter less than the inner diameter of the bearing 172 thereby defining a circumferential gap 306 therebetween. The gap 306 is larger than the difference between the plate eccentric "p" and the theoretical eccentric "t" wherein the first crank shaft 174' does not engage the inner surface of the bearing 172 when located a distance equivalent to the theoretical eccentric "t" from the second crank shaft 192'.

Figure 18:
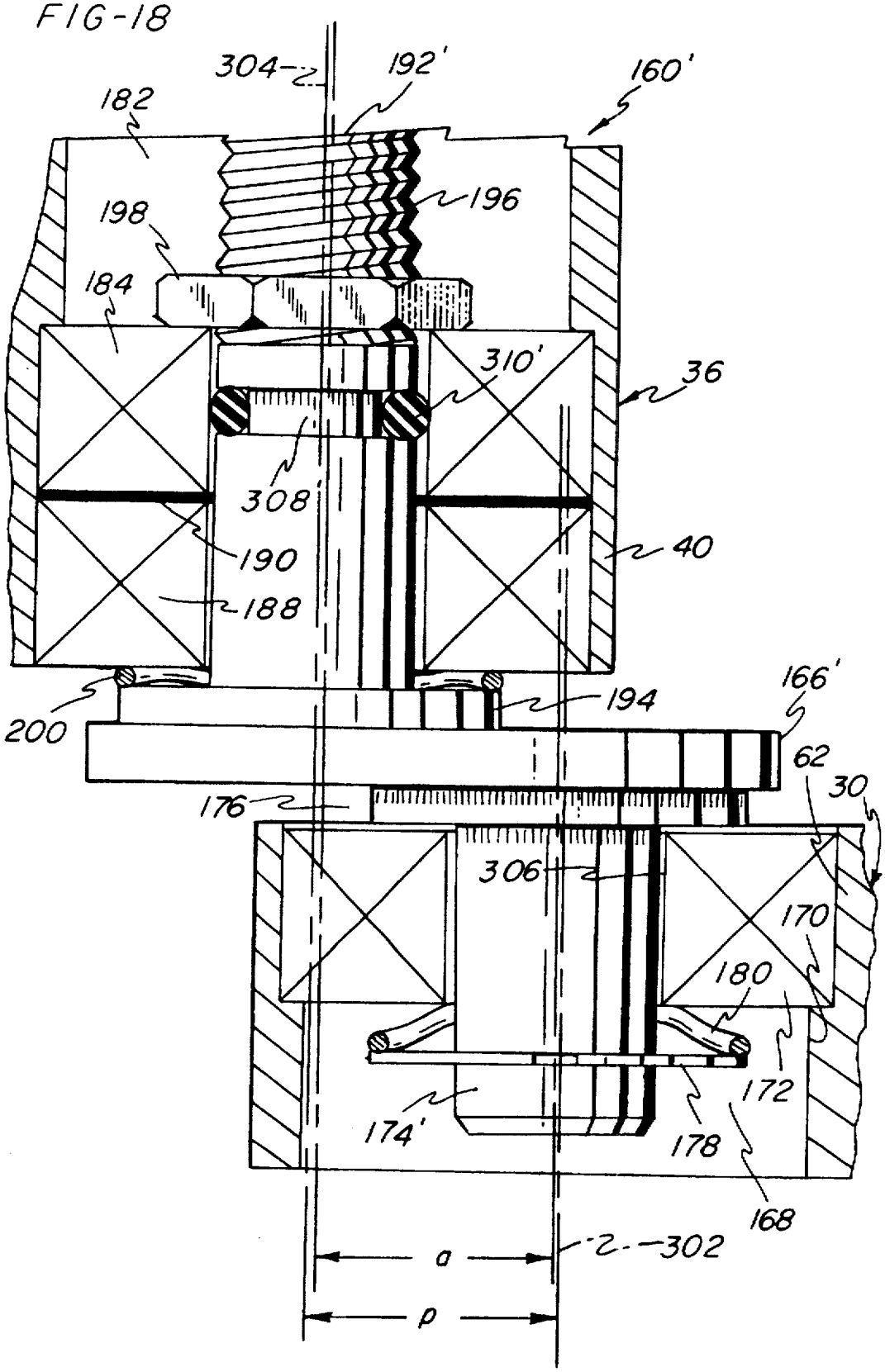
FIG. 18 is an enlarged view of an alternative embodiment of an idler crank assembly of the scroll apparatus of FIG. 16.

The first crank shaft 174' has a peripheral groove 308 for receiving an idler crank resilient compressible member 310. The resilient compressible member 310 is preferably an o-ring and serves to fill the gap 306 between the first crank shaft 174' and the bearing 172. As illustrated in FIG. 18, the resilient compressible member 310' may be located in a peripheral groove 308' on the second crank shaft 192' for engaging the outboard bearing 184 or the inboard bearing 188.

In one embodiment, the plate eccentric "p" between the first crank shaft axis 302 and second crank shaft axis 304 is greater than the theoretical eccentric "t" between the orbiting and stationary involute center axes 74 and 58, wherein the first crank shaft 174' will exert a force against the resilient compressible member 310 and bearing 172 outwardly along a radius formed generally by the first and second crank shaft axes 302 and 304. This force will be transferred to the orbiting scroll member 38 causing the orbiting involute center axis 74 to move radially outwardly relative to the stationary involute center axis 58 thereby defining the actual eccentric "a". The actual eccentric "a" will be less than the plate eccentric "p" since the resilient compressible member 308 or 308' will assume a portion of the eccentric. The orbiting involute 68 will be loaded against the stationary involute 50 thereby creating a tangential sealing relationship between the scroll members 36 and 38.

In another embodiment, the plate eccentric "p" between the crank shaft axes 302 and 304 is less than the theoretical eccentric "t". The crank shaft 174' will therefore exert a force against the resilient compressible member 310 inwardly along a radius formed by the first and second crank shaft axes 302 and 304. The inwardly acting force will be transferred to the orbiting scroll member 38 thereby causing the involute center axis 74 to move radially inwardly relative to the stationary involute center axis 58 and defining the actual eccentric "a". The centrifugal force created in the orbiting scroll member 38 by its orbiting motion will be partially opposed by the inwardly acting force resulting in reduced contact force between the involutes 68 and 50. Friction and wear between the involutes 68 and 50 will therefore be reduced while the remaining centrifugal force will provide effective tangential sealing.

In these alternative embodiments wherein the actual eccentric is defined by the idler crank assembly 160', the drive shaft 84' may simply comprise a single member 312 which connects the motor shaft 22 eccentrically to the orbiting scroll member 38 such that an orbiting motion is imparted to the orbiting scroll member 38 as the motor shaft 22 rotates. Radial compliance within the drive shaft 84' would be provided by internal clearances in the bearing 124.

It should be apparent from the above description that the present invention provides a scroll fluid displacement apparatus which provides efficient tangential and radial sealing through a single simple mechanism. Furthermore, the present invention provides such a scroll apparatus wherein wear is essentially self-compensating to provide for continued effective radial sealing.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A scroll fluid displacement apparatus comprising:

a housing including a circumferential side wall and a first end wall;

a motor shaft having a longitudinal axis and extending into said housing, said motor shaft rotatably mounted in said first end wall;

a stationary scroll member fixed to said housing and including a stationary plate having an inboard surface and an outboard surface, and a stationary involute having a center axis and extending from said inboard surface;

an orbiting scroll member including an orbiting plate having an inboard surface and an outboard surface, and an orbiting involute having a center axis and extending from said inboard surface of said orbiting plate, wherein said stationary and orbiting involutes mesh to define at least one fluid pocket of variable volume and pressure and a theoretical eccentric between said stationary involute center axis and said orbiting involute center axis;

a drive shaft eccentrically mounted to said motor shaft and rotatably mounted to said orbiting plate for orbitally rotating said orbiting scroll member in response to rotation of said motor shaft;

wherein said orbiting involute center axis and said stationary involute center axis are separated by an actual eccentric greater than said theoretical eccentric, thereby creating a radially outwardly acting force between said orbiting involute and said stationary involute;

an idler crank assembly extending between said stationary scroll member and said orbiting scroll member, said idler crank assembly including a first idler crank rotatably mounted in said orbiting scroll member and a second idler crank rotatably mounted in said stationary scroll member, said first and second idler cranks being operably connected such that the orbit of said first idler crank is relative to the orbit of said second idler crank when said orbiting scroll is orbited; and wherein said idler crank assembly is supported for floating axial movement relative at least one of said stationary and orbiting scroll member, thereby facilitating floating axial movement of said orbiting scroll member relative said stationary scroll member.

2. The scroll fluid displacement apparatus of claim 1 wherein said stationary and orbiting involutes have a thickness, a pitch and an angular phase shift, said theoretical eccentric defined by the equation $t=(p/2)-I$, wherein t equals said theoretical eccentric, p equals said involute pitch, and I equals said involute thickness.

3. The scroll fluid displacement apparatus of claim 1 wherein said idler crank assembly is adapted for radial compliance and separates said orbiting involute center axis and said stationary involute center axis thereby defining said actual eccentric.

4. The scroll fluid displacement apparatus of claim 1 wherein said first idler crank is freely movable relative to said orbiting scroll member in a direction parallel to said stationary involute center axis.

5. The scroll fluid displacement apparatus of claim 4 wherein said first idler crank includes:

a crank shaft having first and second ends, a head proximate said first end;

a stop member proximate said second end;

a bearing journaled on said crank shaft between said first and second ends and mounted in said orbiting scroll member;

a spring positioned between said stop member and said bearing for preloading said bearing; and wherein said crank shaft is free to move axially relative to said bearing thereby permitting floating axial movement of said orbiting scroll member relative to said stationary scroll member.

6. The scroll fluid displacement apparatus of claim 4 wherein said first idler crank includes:

a crank shaft having first and second ends, a head proximate said first end;

a bearing journaled on said crank shaft between said first and second ends and mounted in said orbiting scroll member;

a spring positioned between said bearing and said head for preloading said bearing; and wherein said crank shaft is free to move axially relative to said bearing thereby permitting floating axial movement of said orbiting scroll member relative to said stationary scroll member.

7. The scroll fluid displacement apparatus of claim 1 wherein:

said stationary and orbiting involutes each have a height and a tip surface;

said tip surfaces including recessed portions therein for reducing the surface area contacting one of said orbiting plate and said stationary plate of the opposing scroll member; and said recessed portions facilitating accelerated wear of said tip surfaces and movement of said scroll members axially towards each other whereby radial sealing is enhanced between said involutes and said orbiting and stationary plates.

8. The scroll fluid displacement apparatus of claim 7 wherein one of said stationary plate and said orbiting plate further comprises a stabilizing surface having a height less than said involute height and extending from said respective inboard surface, said stabilizing surface supported for selectively contacting the other of said stationary plate and said orbiting plate and thereby retarding continued wear of said tip surfaces.

9. The scroll fluid displacement apparatus of claim 7 wherein said recessed portions have a depth less than 1% of said height of said involutes.

10. The scroll fluid displacement apparatus of claim 7 wherein said recessed portions have a combined cross-sectional area greater than the surface area of said tip surfaces contacting said plates.

11. The scroll fluid displacement apparatus of claim 8 wherein said stabilizing surface extends from said stationary plate circumferentially outside of an area defined by said stationary involute and a path traversed by said orbiting involute.

12. The scroll fluid displacement apparatus of claim 11 wherein said stabilizing surface comprises an inner circumferential member and an outer circumferential member connected to said inner circumferential member.

13. A scroll fluid displacement apparatus comprising:

a housing including a circumferential side wall and a first end wall;

a motor shaft having a longitudinal axis and extending into said housing, said motor shaft rotatably mounted in said first end wall;

a stationary scroll member fixed to said housing and including a stationary plate having an inboard surface and an outboard surface, and a stationary involute having a center axis and extending from said inboard surface;

an orbiting scroll member including an orbiting plate having an inboard surface and an outboard surface, and an orbiting involute having a center axis and extending from said inboard surface, wherein said stationary and orbiting involutes have a thickness, a pitch, an angular phase shift and a theoretical eccentric between said stationary involute center axis and said orbiting involute center axis when said involutes are brought into a meshing relationship to define at least one fluid pocket of variable volume and pressure, said theoretical eccentric defined by the equation $t=(p/2)-I$, wherein t equals said theoretical eccentric, p equals said involute pitch, and I equals said involute thickness;

a drive shaft eccentrically mounted to said motor shaft and rotatably mounted to said orbiting plate for orbitally rotating said orbiting scroll member in response to rotation of said motor shaft, an idler crank assembly extending between said stationary scroll member and said orbiting scroll member, said idler crank assembly including a first idler crank rotatably mounted in said orbiting scroll member and a second idler crank rotatably mounted in said stationary scroll member, said first and second idler cranks being operably connected such that the orbit of said first idler crank is relative to the orbit of said second idler crank when said orbiting scroll is orbited;

wherein said idler crank assembly is adapted for both radial and axial compliance;

said idler crank assembly separating said orbiting involute center axis and said stationary involute center axis by an actual eccentric not equal to said theoretical eccentric, thereby creating a radially acting force between said orbiting involute and said stationary involute; and said idler crank assembly supported for floating axial movement relative at least one of said stationary and orbiting scroll members, thereby facilitating floating axial movement of said orbiting scroll member relative said stationary scroll member.

14. The scroll fluid displacement apparatus of claim 13 wherein said idler crank assembly separates said orbiting involute center axis and said stationary involute center axis by an actual eccentric greater than said theoretical eccentric thereby creating a radially outwardly acting force causing said orbiting involute to maintain a radial contacting relationship with said stationary involute.

15. The scroll fluid displacement apparatus of claim 13 wherein said idler crank assembly separates said orbiting involute center axis and said stationary involute center axis by an actual eccentric less than said theoretical eccentric thereby creating a radially inwardly acting force adapted to oppose a portion of a centrifugal force acting between said orbiting involute and said stationary involute whereby a radial contacting relationship between said involutes is maintained at a level to minimize frictional forces.

16. The scroll fluid displacement apparatus of claim 13 wherein:

said stationary and orbiting involutes each have a height and a tip surface;

said tip surfaces including recessed portions therein for reducing the surface area contacting one of said orbiting plate and said stationary plate of the opposing scroll member; and said recessed portions facilitating accelerated wear of said tip surfaces and movement of said scroll members axially towards each other whereby radial sealing is enhanced between said involutes and said orbiting and stationary plates.

17. The scroll fluid displacement apparatus of claim 16 wherein said recessed portions have a depth less than 1% of said height of said involutes.

18. The scroll fluid displacement apparatus of claim 16 wherein said recessed portions have a combined cross-sectional area greater than said surface area of said tip surfaces contacting said plates.

19. The scroll fluid displacement apparatus of claim 16 wherein one of said stationary plate and said orbiting plate further comprises a stabilizing surface having a height less than said involute height and extending from said respective inboard surface, said stabilizing surface supported for selectively contacting the other of said stationary plate and said orbiting plate and thereby retarding continued wear of said tip surfaces.

20. The scroll fluid displacement apparatus of claim 19 wherein said stabilizing surface extends from said stationary plate circumferentially outside of an area defined by said stationary involute and a path transversed by said orbiting involute.

21. The scroll fluid displacement apparatus of claim 20 wherein said stabilizing surface comprises an inner circumferential member and an outer circumferential member connected to said inner circumferential member.

22. A scroll fluid displacement apparatus comprising:

a housing including a circumferential side wall and a first end wall;

a motor shaft having a longitudinal axis and extending into said housing, said motor shaft rotatably mounted in said first end wall;

a stationary scroll member fixed to said housing and including a stationary plate having an inboard surface and an outboard surface, a stationary involute having a center axis and extending from said inboard surface;

an orbiting scroll member including an orbiting plate having an inboard surface and an outboard surface, and an orbiting involute having a center axis and extending from said inboard surface of said orbiting plate, wherein said stationary and orbiting involutes mesh to define at least one fluid pocket of variable volume and pressure and a theoretical eccentric between said stationary involute center axis and said orbiting involute center axis;

said stationary and orbiting involutes each having a height and a planar tip surface sealingly engaging one of said orbiting plate and said stationary plate of the opposing scroll member, said tip surfaces including recessed portions therein for reducing the surface area contacting one of said orbiting plate and said stationary plate of the opposing scroll member;

a drive shaft eccentrically mounted to said motor shaft and rotatably mounted to said orbiting plate for orbitally rotating said orbiting scroll member in response to rotation of said motor shaft;

said orbiting scroll member and stationary scroll member supported for floating axial movement relative each other; and wherein said recessed portions facilitate accelerated wear of said tip surfaces and movement of scroll members axially toward each other whereby radial sealing is enhanced between said involutes and said stationary and orbiting plates.

23. The scroll fluid displacement apparatus of claim 22 wherein said recessed portions have a depth less than 1% of said height of said involutes.

24. The scroll fluid displacement apparatus of claim 22 wherein said recessed portions have a combined cross-sectional area greater than the surface area of said tip surfaces contacting said plates.

25. The scroll fluid displacement apparatus of claim 22 wherein said recessed portions are cylindrical.

26. The scroll fluid displacement apparatus of claim 22 further comprising a stabilizing surface extending from at least one of said stationary plate and said orbiting plate, said stabilizing surfacing having a height less than said involute height and supported for selectively contacting the other of said stationary plate and said orbiting plate thereby retarding continued wear of said tip surfaces.

27. The scroll fluid displacement apparatus of claim 26 wherein said stabilizing surface extends from said stationary plate circumferentially outside of an area defined by said stationary involute and a path traversed by said orbiting involute.

28. The scroll fluid displacement apparatus of claim 27 wherein said stabilizing surface comprises an inner circumferential member and an outer circumferential member connected to said inner circumferential member.

29. The scroll fluid displacement apparatus of claim 22 wherein said orbiting involute center axis and said stationary involute center axis are separated by an actual eccentric greater than said theoretical eccentric, thereby creating a radially outwardly acting force between said orbiting involute and said stationary involute.

30. A scroll fluid displacement apparatus comprising:

a housing including a circumferential side wall and a first end wall;

a motor shaft having a longitudinal axis and extending into said housing, said motor shaft rotatably mounted in said first end wall;

a stationary scroll member fixed to said housing and including a stationary plate having an inboard surface and an outboard surface, a stationary involute having a center axis and extending from said inboard surface;

an orbiting scroll member including an orbiting plate having an inboard surface and an outboard surface, and an orbiting involute having a center axis and extending from said inboard surface of said orbiting plate, wherein said stationary and orbiting involutes mesh to define at least one fluid pocket of variable volume and pressure and a theoretical eccentric between said stationary involute center axis and said orbiting involute center axis;

said stationary and orbiting involutes each having a height and a tip surface, said tip surfaces including recessed portions therein for reducing the surface area contacting one of said orbiting plate and said stationary plate of the opposing scroll member;

said recessed portions having a depth less than 1% of said height of said involutes and a combined cross-sectional area greater than said surface area contacting said stationary and orbiting plates;

stabilizing surface extending from at least one of said stationary plate and said orbiting plate, said stabilizing surface having a height less than said involute height and supported for selectively contacting the other of said stationary plate and said orbiting plate;

a drive shaft eccentrically mounted to said motor shaft and rotatably mounted to said orbiting plate for orbitally rotating said orbiting scroll member in response to rotation of said motor shaft;

said orbiting scroll member and stationary scroll member supported for floating axial movement relative each other; and wherein said recessed portions facilitate accelerated wear of said tip surfaces and movement of scroll members axially toward each other whereby radial sealing is enhanced between said involutes and said plates of said opposing scroll members.

* * * * *

UNITED STATES PATENT AND TRADEMARK OFFICE

CERTIFICATE OF CORRECTION

PATENT NO. : 5,752,816

DATED : May 19, 1998

INVENTOR(S) : Robert W. Shaffer

It is certified that error appears in the above-indentified patent and that said Letters Patent is hereby corrected as shown below:

In Column 18, line 66, "transversed" should be traversed .

Signed and Sealed this

Twenty-fifth Day of August, 1998

Bruce Lehman

*Attest:*

BRUCE LEHMAN

*Attesting Officer*

*Commissioner of Patents and Trademarks*